US011340538B2

(12) United States Patent
Nohara et al.

(10) Patent No.: US 11,340,538 B2
(45) Date of Patent: May 24, 2022

(54) CONTAINER ATTACHMENT DEVICE AND IMAGE FORMING APPARATUS

(71) Applicant: KYOCERA Document Solutions Inc., Osaka (JP)

(72) Inventors: Yuta Nohara, Osaka (JP); Tomohisa Soda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/024,394

(22) Filed: Sep. 17, 2020

(65) Prior Publication Data

US 2021/0080855 A1 Mar. 18, 2021

(30) Foreign Application Priority Data

Sep. 18, 2019 (JP) ..... JP2019-169453
Sep. 18, 2019 (JP) ..... JP2019-169454

(51) Int. Cl.
*G03G 15/08* (2006.01)
*G03G 21/16* (2006.01)
*G03G 21/12* (2006.01)

(52) U.S. Cl.
CPC ..... *G03G 15/086* (2013.01); *G03G 15/087* (2013.01); *G03G 15/0872* (2013.01); *G03G 15/0891* (2013.01); *G03G 21/12* (2013.01); *G03G 21/1642* (2013.01); *G03G 21/1647* (2013.01)

(58) Field of Classification Search
CPC .. G03G 15/0872; G03G 15/087; G03G 21/12; G03G 21/1642; G03G 21/1647; G03G 2221/1654; G03G 2221/066; G03G 2221/0692; G03G 15/0868
See application file for complete search history.

(56) References Cited

U.S. PATENT DOCUMENTS 9,256,194 B2 * 2/2016 Nakajima ..... G03G 21/1676
10,558,168 B2 * 2/2020 Ohkubo ..... G03G 21/185
2021/0034007 A1 * 2/2021 Tamaki ..... G03G 15/086

FOREIGN PATENT DOCUMENTS

JP H06-202529 A 7/1994
JP 2018-066789 A 4/2018

* cited by examiner

*Primary Examiner* — Arlene Heredia
(74) *Attorney, Agent, or Firm* — Studebaker & Brackett PC

(57) ABSTRACT

A container attachment device includes a toner container, an attached part for the toner container and a displacement sensor. The displacement sensor faces to the toner container to detect electrostatic capacity according to the toner. The attached part includes a cover opening/closing an opening of the toner container. The cover closing or opening the opening faces to the displacement sensor, and the cover opening or closing the opening is away from the displacement sensor. The displacement sensor detects the electrostatic capacity varying among a first condition opening the cover and detaching the toner container, a second condition closing the cover and detaching the toner container, a third condition opening the cover and attaching the toner container, and a fourth condition closing the cover and attaching the toner container. In the third or fourth condition, the displacement sensor detects the electrostatic capacity according to a toner quantity in the toner container.

4 Claims, 22 Drawing Sheets

CONTAINER ATTACHMENT DEVICE AND IMAGE FORMING APPARATUS

INCORPORATION BY REFERENCE

This application is based on and claims the benefit of priority from Japanese Patent applications No. 2019-169453 and No. 2019-169454 filed on Sep. 18, 2019, the entire contents of which are incorporated herein by reference.

BACKGROUND

The present disclosure relates to a container attachment device to which a toner container is attached and an image forming apparatus.

For example, an image forming apparatus transfers an image to a recording medium by a toner supplied from an attachable toner bottle in an electrographic manner. At a plurality of positions of the toner bottle, a plurality of detecting means are provided, toner distribution in the toner bottle is calculated on the basis of detecting results of the plurality of detecting means, and a residual quantity of the toner bottle is estimated by the toner distribution.

Moreover, for example, the image forming apparatus includes a cleaning device eliminating a residual toner not transferred to the recording medium from an image carrier. The cleaning device includes a storing container storing the residual toner and first and second detecting means detecting that the residual toner in the storing container reaches a predetermined quantity. The first and second detecting means are arranged in the storing container to detect a state that the storing container becomes close to full or a state the storing container becomes full.

In general, in the image forming apparatus, a cover (door) is provided and opened/closed when replacing the toner bottle or the storing container (hereinafter, called as a "storing container or the like"). In order to prevent forgetting to close the cover when replacing the storing container or the like, in the image forming apparatus, an exclusive sensor detecting opening/closing of the cover is often provided.

However, in the above-mentioned image forming apparatus, a means detecting a toner quantity and a means detecting opening/closing of the cover must be severally provided. Therefore, there are problems that peripheral structure of an attached part for the storing container or the like is complicated and manufacturing cost is increased.

In general, in the image forming apparatus, a cover (door) is provided and opened/closed when replacing the toner bottle. Considering easiness of attaching/detaching of the toner bottle when replacing, it is preferable that the toner bottle is arranged horizontally. On the other hand, when activating the image forming apparatus, in order to made the toner easily smoothly flow to a discharging port, it is preferable that the toner bottle is inclined downwardly toward a side of the discharging port. Moreover, for example, in a case of a device collecting a waste toner not transferred to the recording medium in the toner bottle, when activating the image forming apparatus, in order to make the waste toner easily flow in a direction away from the discharging port, it is preferable that the toner bottle is inclined downwardly toward an opposite side to the discharging port. However, in the above-mentioned image forming apparatus, it is not sufficiently considered about a posture of the toner bottle when replacing the toner bottle and when activating the image forming apparatus.

SUMMARY

A container attachment device in accordance with the present disclosure includes a toner container storing a toner, an attached part to which the toner container is attached detachably, and a displacement sensor. The displacement sensor is arranged to face to the toner container attached to the attached part to detect electrostatic capacity according to the toner stored in the toner container. The attached part includes a cover opening/closing an opening for attaching/detaching the toner container. A part of the cover in a condition closing the opening is arranged to face to the displacement sensor and the part of the cover in a condition opening the opening is moved away from a position facing to the displacement sensor. Alternatively, the part of the cover in the condition opening the opening is arranged to face to the displacement sensor and the part of the cover in the condition closing the opening is moved away from a position facing to the displacement sensor. The displacement sensor detects the electrostatic capacity varying among a first condition that the cover is opened and the toner container is detached from the attached part, a second condition that the cover is closed and the toner container is detached from the attached part, a third condition that the cover is opened and the toner container is attached to the attached part, and a fourth condition that the cover is closed and the toner container is attached to the attached part. In the third condition or the fourth condition, the displacement sensor detects the electrostatic capacity varying in accordance with a quantity of the toner stored in the toner container.

Alternatively, a container attachment device in accordance with the present disclosure includes a toner container, and an attached part to which the toner container is attached detachably along the axial direction. The toner container is extended in an axial direction and formed so as to store a toner, and has a communicating port arranged one side in the axial direction to discharge or to introduce the toner. The attached part includes a cover opening/closing an opening for attaching/detaching the toner container, and an angle changing mechanism. The angle changing mechanism sets the toner container arranged horizontally in a condition opening the cover to a first posture of the toner container and sets the toner container inclined downwardly from the other side in the axial direction to the communicating port in a condition closing the cover to a second posture of the toner container. Alternatively, the angle changing mechanism sets the toner container arranged horizontally or inclined upwardly from the communicating port to the other side in the axial direction in a condition opening the cover to the first posture of the toner container and sets the toner container inclined downwardly from the communicating port to the other side in the axial direction in a condition closing the cover to the second posture of the toner container.

An image forming apparatus in accordance with the present disclosure includes any one of the container attachment devices as described above.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the accompanying drawings, preferable embodiments of the present disclosure will be described. Incidentally, in the figures, "Fr" indicates a "front side", "Rr" indicates a "rear side" (back side), "L" indicates a "left side", "R" indicates a "right side", "U" indicates a "up side" and "D" indicates a "down side" (lower side). In the present specification, terms indicating directions and positions are used for convenience of explanation, but the terms do not restrict a technical range of the present disclosure.

First Embodiment

Figure 1:
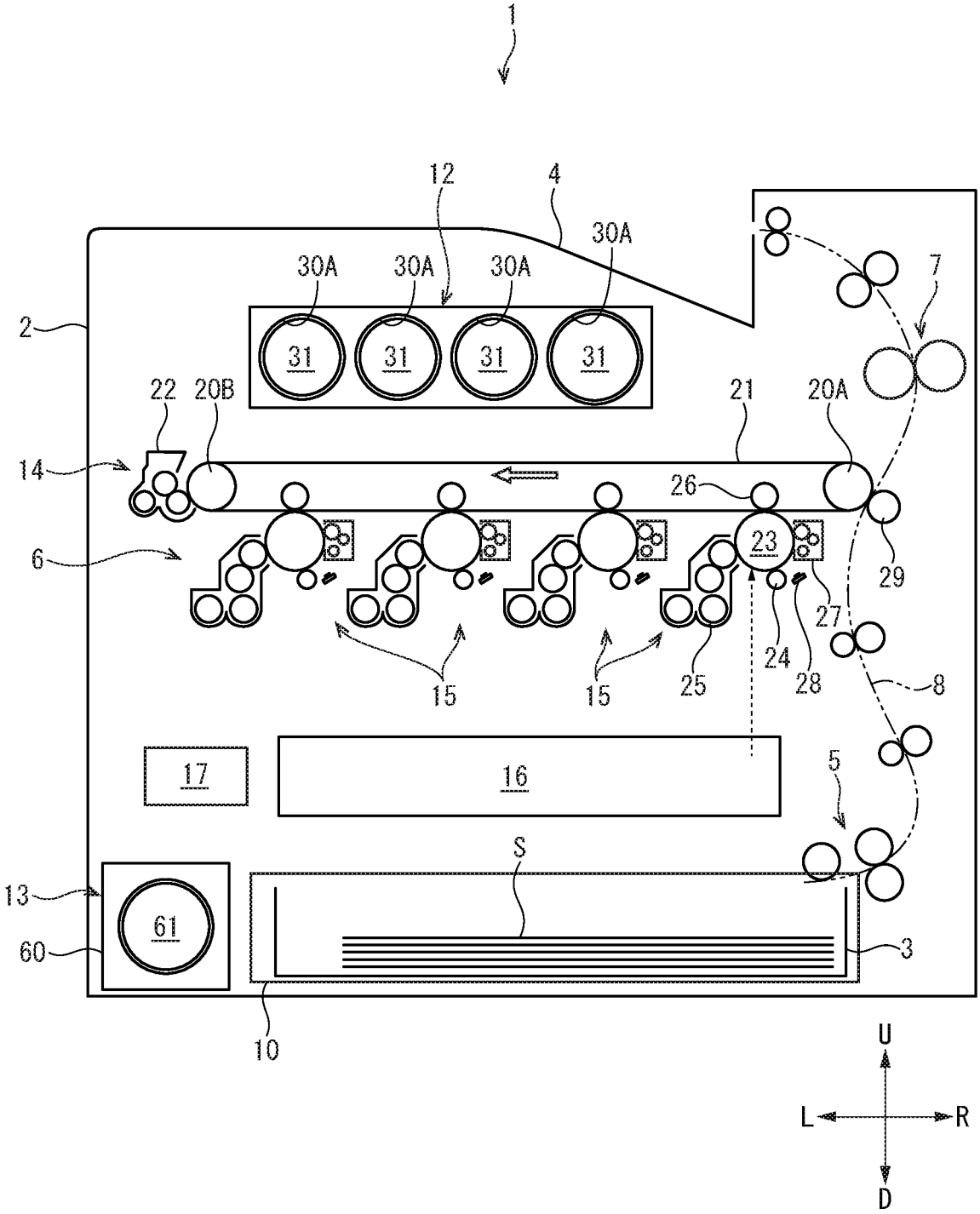
FIG. 1 is a front sectional view schematically showing an internal structure of an image forming apparatus according to a first embodiment of the present disclosure.
Figure 2:
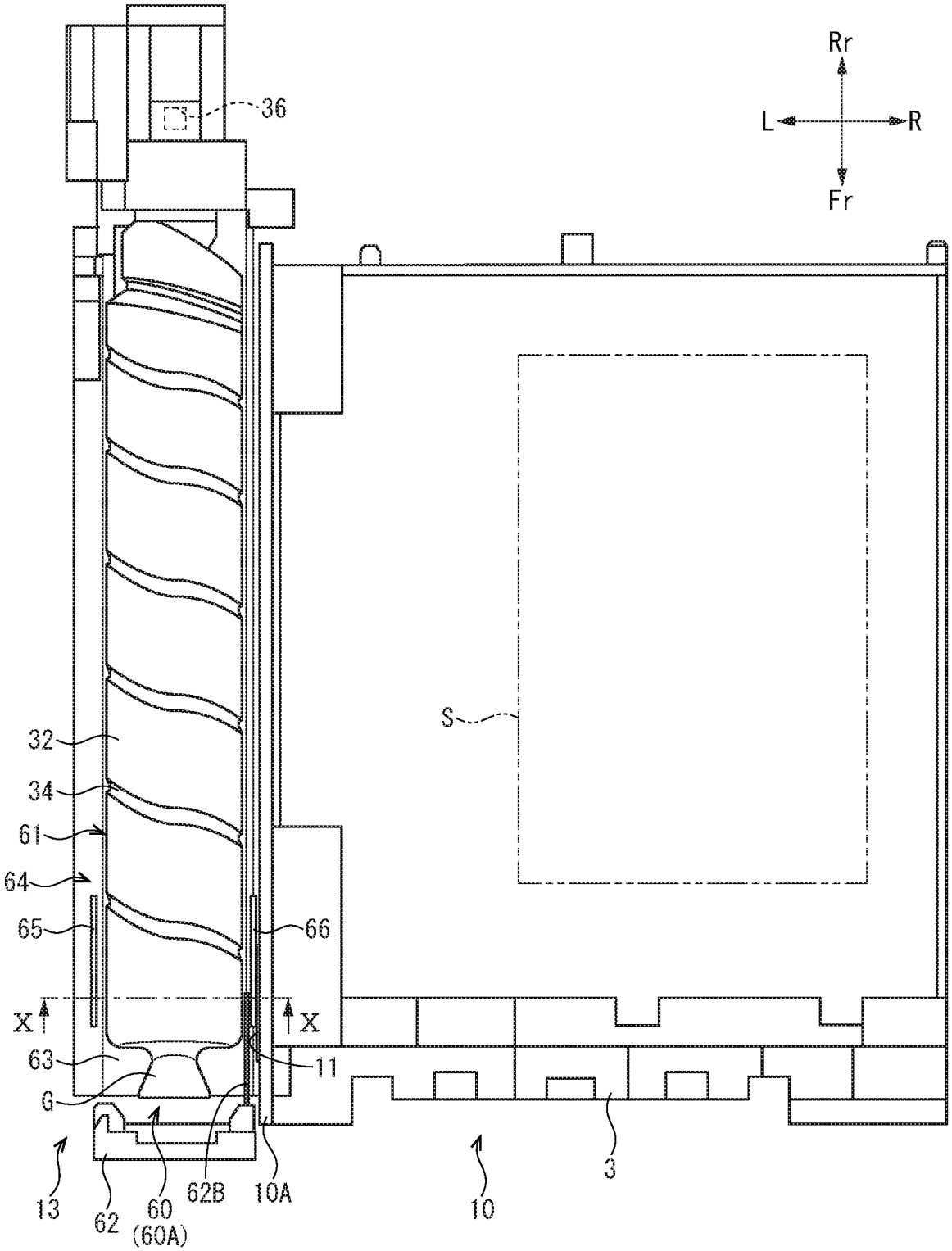
FIG. 2 is a plane view showing a sheet feeding cartridge, a waste toner collecting device and others in the image forming apparatus according to the first embodiment of the present disclosure.
Figure 3:
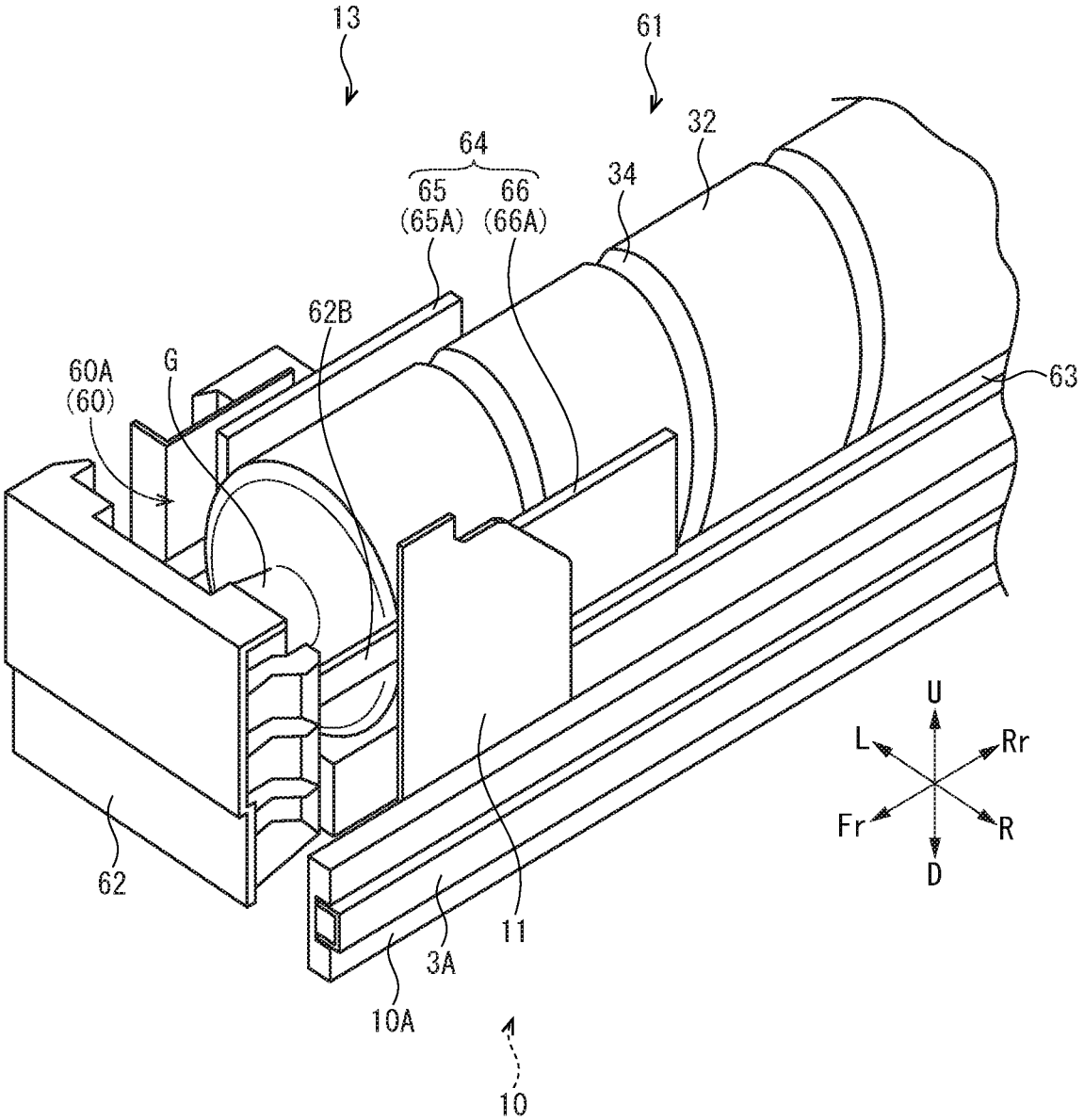
FIG. 3 is a perspective view showing a front periphery of the waste toner collecting device according to the first embodiment of the present disclosure.

With reference to FIGS. 1 to 3, an image forming apparatus 1 according to a first embodiment will be described. FIG. 1 is a front sectional view showing an internal structure of the image forming apparatus 1. FIG. 2 is a plane view showing a sheet feeding cartridge 3, a waste toner collecting device 13 and others. FIG. 3 is a perspective view showing a front periphery of the waste toner collecting device 13.

<Summary of Image Forming Apparatus>

The image forming apparatus 1 is a color printer transferring a full color toner image formed in a electrographic manner to a sheet S to form an image. As shown in FIG. 1, the image forming apparatus 1 includes an apparatus body 2 constituting an external appearance of a roughly rectangular parallelepiped shape. At a lower side in the apparatus body 2, a cartridge attached part 10 for attaching a sheet feeding cartridge 3 is provided. In the sheet feeding cartridge 3, for example, the sheet S (or a sheaf of sheets S) made of paper is stored. On an upper face of the apparatus body 2, an ejected sheet tray 4 receiving the sheet S after image forming is provided. Incidentally, the sheet S is not restricted by paper, and may be a resin film, an OHP sheet or the like.

The cartridge attached part 10 constitutes a space to which the sheet feeding cartridge 3 is attached. In a lower front face in the apparatus body 2, a front face opening of the cartridge attached part 10 is formed in order to attach or detach the sheet feeding cartridge 3. The sheet feeding cartridge 3 is formed in a roughly rectangular parallelepiped shape (box shape) having an opened upper face. The sheet feeding cartridge 3 is attached to the cartridge attached part 10 attachably/detachably.

As shown in FIGS. 2 and 3, on both left and right side faces of the sheet feeding cartridge 3, a pair of slide guides 3A is fixed, and at both left and right sides of the cartridge attached part 10, a pair of cartridge rails 10A are provided (FIGS. 2 and 3 illustrate only the left side). The slide guides 3A and the cartridge rails 10A are made of, for example, metal material, such as stainless steel. The pair of cartridge rails 10A hold the pair of slide guides 3A slidably. Thereby, the pair of cartridge rails 10A support the sheet feeding cartridge 3 slidably via the pair of slide guides 3A.

Moreover, at both left and right sides of the cartridge attached part 10, a pair of rail holding members 11 holding the pair of cartridge rails 10A are provided (FIGS. 2 and 3 illustrate only the left side). The rail holding members 11 are made of, for example, metal plate, such as stainless steel. The rail holding members 11 are arranged at the front side (the front side from the center of forward and backward directions) of the cartridge attached part 10. The rail holding members 11 are provided in a standing posture along the forward and backward directions. The cartridge rails 10A are fixed to the rail holding members 11, and the rail holding members 11 are fixed to the apparatus body 2.

Moreover, as shown in FIG. 1, the image forming apparatus 1 includes a sheet feeding part 5, an image forming part 6, a fixing device 7, a toner replenishing device 12 and a waste toner collecting device 13 inside the apparatus body 2. The sheet feeding part 5 is arranged at an upstream side in a conveying path 8 extending from the sheet feeding cartridge 3 to the ejected sheet tray 4. The fixing device 7 is arranged at an downstream side in the conveying path 8, and the image forming part 6 is arranged between the sheet feeding part 5 and fixing device 7 in the conveying path 8. The toner replenishing device 12 is arranged above the image forming part 6. The waste toner collecting device 13 is arranged below the image forming part 6.

The image forming part 6 includes an intermediate transferring unit 14, four drum units 15 and an optical scanning device 16. The intermediate transferring unit 14 is arranged below the ejected sheet tray 4. The four drum units 15 are arranged in parallel in left and right directions at the lower side of the intermediate transferring unit 14. The optical scanning device 16 is arranged at the lower side of the respective drum units 15.

The intermediate transferring unit 14 includes an intermediate transferring belt 21 wound around a driving roller 20A arranged at the right side inside the apparatus body 2 and a following roller 20B arranged at the left side inside the apparatus body 2. When the driving roller 20A is driven and rotated by a motor (not shown), the intermediate transferring belt 21 is rotated in a counter clockwise direction (referring to an arrow in FIG. 1). Moreover, at the left side of the following roller 20B, a belt cleaning device 22 is arranged.

The four drum units 15 are provided so as to correspond to toners of four colors. Each drum unit 15 includes a photosensitive drum 23, a electric charging device 24, a developing device 25, a primary transferring roller 26, a drum cleaning device 27 and a static eliminating device 28. Incidentally, since the four drum units 15 have similar structures, one drum unit 15 will be described hereinafter.

The photosensitive drum 23 is driven and rotated by a motor (not shown) while coming into contact with a lower surface of the intermediate transferring belt 21. The electric charging device 24, the developing device 25, the primary transferring roller 26, the drum cleaning device 27 and the static eliminating device 28 are arranged around the photosensitive drum 23 in order of transferring process. The primary transferring roller 26 is arranged so as to face to the photosensitive drum 23 from the upper side across the intermediate transferring belt 21. With the right side of the intermediate transferring belt 21 (the driving roller 20A), a secondary transferring roller 29 comes into contact.

As described later in detail, in the toner replenishing device 12, four toner bottles 31 are attached detachably. In the four toner bottles 31, replenishing toners (developers) of four colors (yellow, magenta, cyan, black) are stored. The four toner bottles 31 communicate with four developing devices 25 via replenishing tubes (not shown) or the like incorporating screws to supply the replenishing toners to the four developing devices 25. In the waste toner collecting device 13, a collecting bottle 61 is attached detachably. In the collecting bottle 61, a waste toner not transferred to the sheet S and discharged is stored (collected).

Moreover, in the forming apparatus 1, a controlling part 17 suitably controlling control object devices, such as the image forming part 6, is provided. The controlling part 17 includes a processor or the like executing various operation processing in accordance with a program or a parameter stored in a memory. Incidentally, the controlling part 17 may be actualized by a logical circuit (hardware) provided in an integrated circuit or the like in place of the processor or the like executing the program or the like.

Hereupon, operation of the image forming apparatus 2 will be described. The controlling part 17 executes image forming process as follows on the basis of inputted image data.

The electric charging device 24 electrically charges a surface of the photosensitive drum 23. The optical scanning device 16 performs exposure corresponding the image data to the photosensitive drum 23 to form an electrostatic latent image to the surface of the photosensitive drum 23. The developing device 25 develops the electrostatic latent image formed on the surface of the photosensitive drum 23 to the toner image by using the toner supplied from the toner bottle 31 of the toner replenishing device 12. Four toner images carried on surfaces of four photosensitive drums 23 are primarily transferred to the intermediate transferring belt 21 in order by four primary transferring rollers 26 to which primary transferring bias is applied. Thereby, on the surface of the intermediate transferring belt 21, the full color toner image is formed.

On the other hand, the sheet feeding part 5 feeds out the sheet S in the sheet feeding cartridge 3 to the conveying path 8. The secondary transferring roller 29 secondarily transfers the toner image of the intermediate transferring belt 21 to the sheet S passing though between the secondary transferring roller 29 and the intermediate transferring belt 21. The fixing device 7 thermally fixes the toner image to the sheet S. After that, the sheet S is ejected to the ejected sheet tray 4. The drum cleaning device 27 eliminates the waste toner (residual toner) remained on the surface of the photosensitive drum 23 after primary transferring. The static eliminating device radiates a static eliminating light to the photosensitive drum 23 to eliminate electric charge of the photosensitive drum 23. Moreover, the belt cleaning device 22 eliminates the waste toner remained on the surface of the intermediate transferring belt 21 after secondary transferring. The waste toner eliminated from the photosensitive drum 23 or the intermediate transferring belt 21 is collected in the collecting bottle 61.

<Toner Replenishing Device>

Figure 4:
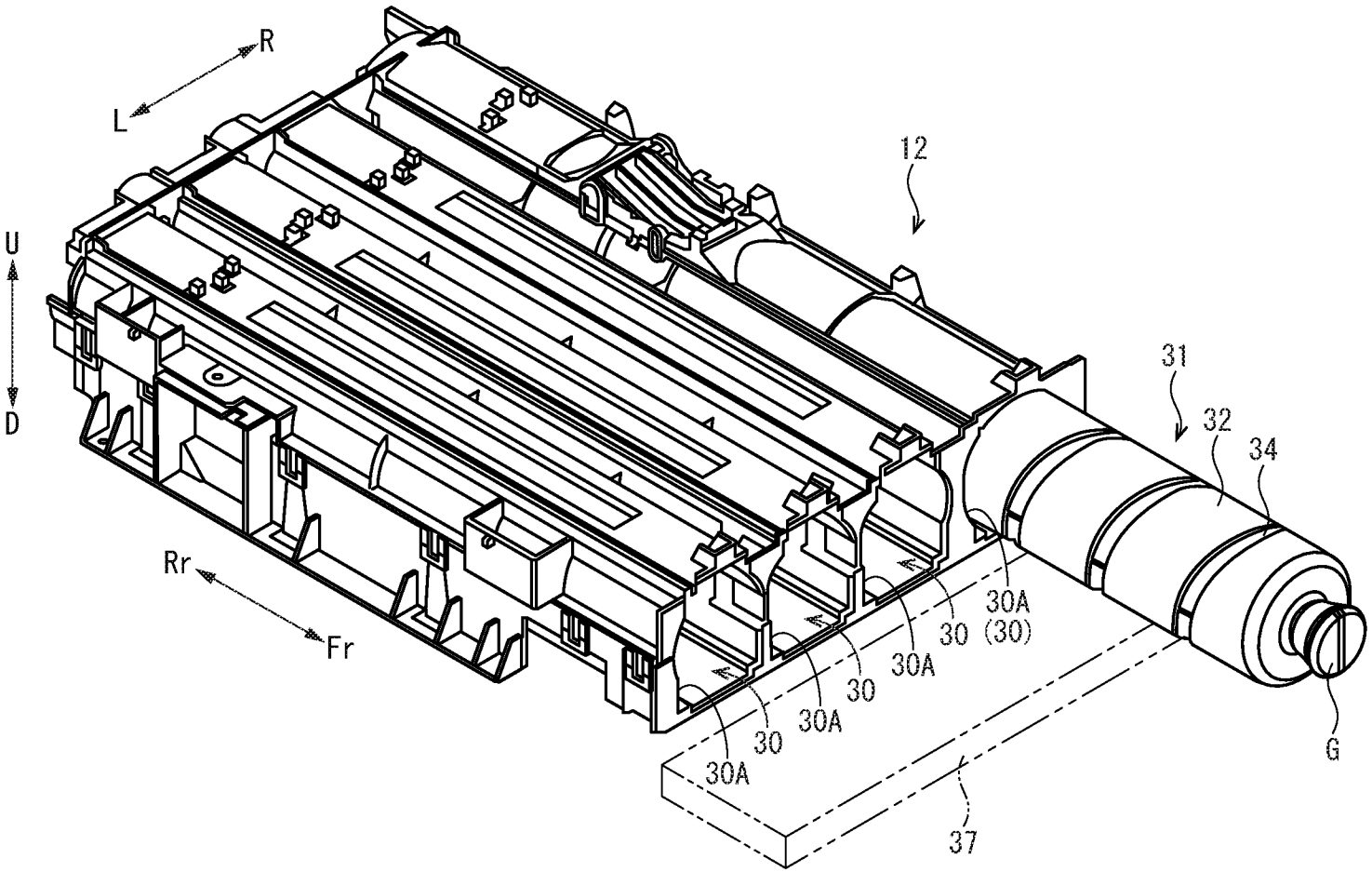
FIG. 4 is a perspective view showing a toner replenishing device according to the first embodiment of the present disclosure.
Figure 5:
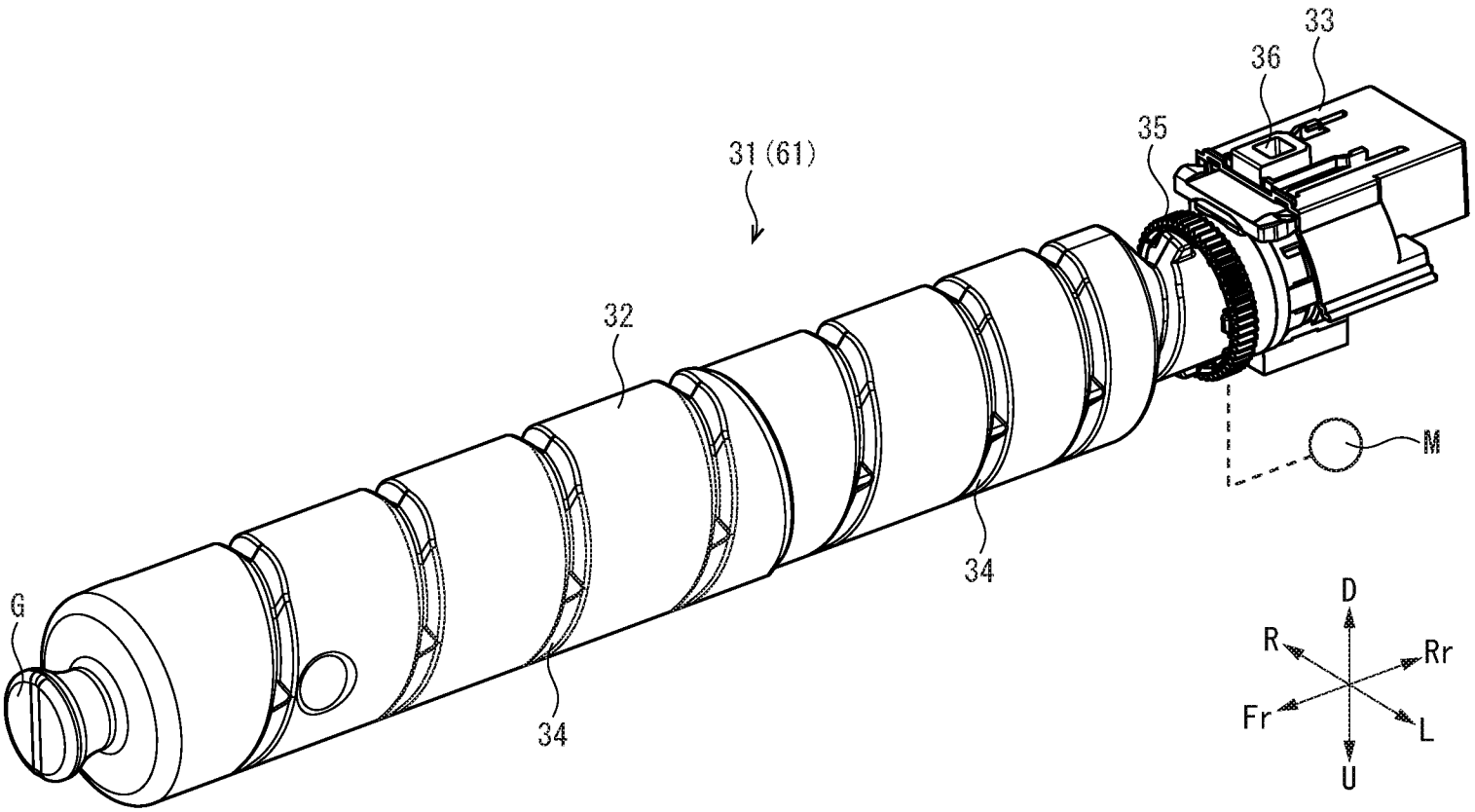
FIG. 5 is a perspective view showing a toner bottle provided in the image forming apparatus according to the first embodiment of the present disclosure.

Next, with reference to FIGS. 4 and 5, the toner replenishing device 12 will be described. FIG. 4 is a perspective view showing the toner replenishing device 12. FIG. 5 is a perspective view showing the toner bottle 31.

The toner replenishing device 12 is arranged above the intermediate transferring unit 14 (the developing device 25) (referring to FIG. 1). As shown in FIG. 4, the toner replenishing device 12 includes four replenishing side attached parts 30 (attached part) to which the four toner bottles 31 are attached (inserted) detachably along the forward and backward directions (an axial direction). Each replenishing side attached part 30 constitutes a space to which each toner bottle 31 is attached. In an upper front face of the apparatus body 2, a replenishing side opening 30A of the replenishing side attached part 30 is formed in order to attach or detach the toner bottle 31. In the replenishing side attached part 30, a replenishing cover 37 is provided in order to open or close the replenishing side opening 30A. The replenishing cover 37 is provided so as to rotate around an axis arranged at a lower side.

«Toner Bottle»

As shown in FIG. 5, each toner bottle 31 (a toner container) is extended in the forward and backward directions (the axial direction) and thereby so as to store the toner. Each toner bottle 31 includes a container body 32 and a cap 33. Incidentally, the toner bottle 31 storing a black toner is formed thicker than (with a larger diameter than) the other color toner bottles 31, and the right side replenishing side attached part 30 for attaching the toner bottle 31 for black is formed with a larger diameter than the other replenishing side attached part 30 (referring to FIG. 1). Moreover, because the four toner bottles 31 have same configuration except for a difference of a thickness, one toner bottle 31 will be described hereinafter. In addition, in the following description, a direction is defined on the basis of a condition that the toner bottler 31 is attached to the replenishing side attached part 30. Incidentally, the toner may be two-component developer containing the toner and a carrier, or one-component developer composed of a magnetic toner. Moreover, all of the four toner bottles 31 (the four replenishing side attached parts 30) may have same dimension (same diameter).

«<Container Body>»

The container body 32 is, for example, made of synthetic resin material, such as PET resin (polyethylene terephthalate), and formed in a roughly cylindrical shape lengthened in the forward and backward directions. In the container body 32, a helical conveying rib 34 protruded to an inner side in a radial direction (toward an axial center) from an outer circumference face of the container body 32 is formed in a body. The container body 32 and the helical conveying rib 34 are formed with almost the same thickness. On a front end face of the container body 32, a grip part G gripped by a user is protruded. A rear portion of the container body 32 is formed thinner than the other portion of the container body 32, and a rear end face of the container body 32 is opened (not shown). At the rear portion (a thinned portion) of the container body 32, a roughly annular transmitting gear 35 is fixed. The transmitting gear 35 is connected to a driving motor M via a power transmitting mechanism, such as a shaft and a gear. As described later in detail, the container body 32 is driven by the driving motor M and rotated around an axis, and the conveying rib 34 is rotated together with the container body 32 to make conveying force along in an axial direction act on the toner inside the container body 32. Incidentally, although an example that the conveying rib 34 is formed together with the container body 32 in a body was described, the present disclosure is not restricted by this example, and the conveying rib and the container body are constituted by separate members (not shown).

«<Cap>»

The cap 33 is arranged at the back side from the transmitting gear 35 and attached to the container body 32 so as to cover the rear end face (an opening) of the container body 32. The cap 33 supports a rear end (one side in an axial direction) of the container body 32 rotatably around an axis. The cap 33 includes a communicating port 36 communicating with the inside of the container body 32. The communicating port 36 is a roughly rectangular hole formed in a lower side face of the cap 33. Moreover, in the cap 33, a shutter (not shown) opening/closing the communicating port 36 is provided slidably in an axial direction (forward and backward directions). In a condition that the toner bottle 31 is detached from the replenishing side attached part 30, the shutter closed the communicating port 36.

<Attaching of Toner Bottle>

Hereupon, procedure attaching the toner bottle 31 to the replenishing side attached part 30 will be described. As shown in FIG. 4, the user opens the replenishing cover 37 of the replenishing side attached part 30 to expose the replenishing side opening 30A, and inserts the toner bottle 31 into the replenishing side attached part 30 (the replenishing side opening 30A) in a state that the grip part G is directed to the front side and the communicating port 36 is directed to the lower side. In process inserting the toner bottle 31, the shutter is slid relatively forward by coming into contact with a part of the replenishing side attached part 30 to open the communicating port 36. The opened communicating port 36 is connected to an upstream end of the replenishing tube. After that, the user closes the replenishing cover 37.

By the above-described procedure, attaching of the toner bottle 31 is completed. In this condition, the replenishing side attached part 30 fixes the cap 33 and supports the container body 32 rotatably. Moreover, in this condition, the transmitting gear 35 is connected to the driving motor M via the power transmitting mechanism, and the communicating port 36 is connected to the developing device 25 via the replenishing tube and others.

«<Replenishing of Toner>»

When the driving motor M is driven by a toner replenishing command from the controlling part 17, the container body is rotated around an axis together with the transmitting gear 35 in a body. When the container body (the conveying rib 34) attached to the replenishing side attached part 30 is rotated around an axis, the replenishing toner stored inside the container body 32 is conveyed to the communicating port 36 arranged at the rear side (one side in an axial direction). The toner is passed through the replenishing tube from the communicating port 36 and supplied (replenished) to the developing device 25.

Incidentally, in the replenishing side attached part 30, a residual quantity confirmation sensor (an electrostatic capacity sensor or the like) detecting a toner quantity stored in the toner bottle 31 is provided (not shown). The residual quantity confirmation sensor is arranged to face to the toner bottle 31 attached to the replenishing side attached part 30 to detect electrostatic capacity according to a residual quantity of the toner. The controlling part 17 decides on the basis of a detecting result of the residual quantity confirmation sensor that the toner bottle 31 becomes empty (or the toner becomes less), and displays, for example, a message or the like indicating empty of the toner bottle 31 or encouraging replacement of the toner bottle 31 on a touch panel (not shown) provided in the image forming apparatus 1. When replacing the empty (or less) toner bottle 31, the user grasps the grip part G and pulls the toner bottle 31 out to the front side, and thereby, detaches the toner bottle 31 from the replenishing side attached part 30. According to pulling-out of the toner bottle 31, the shutter is biased backward by a spring (not shown) to close the communicating port 36.

Figure 6:
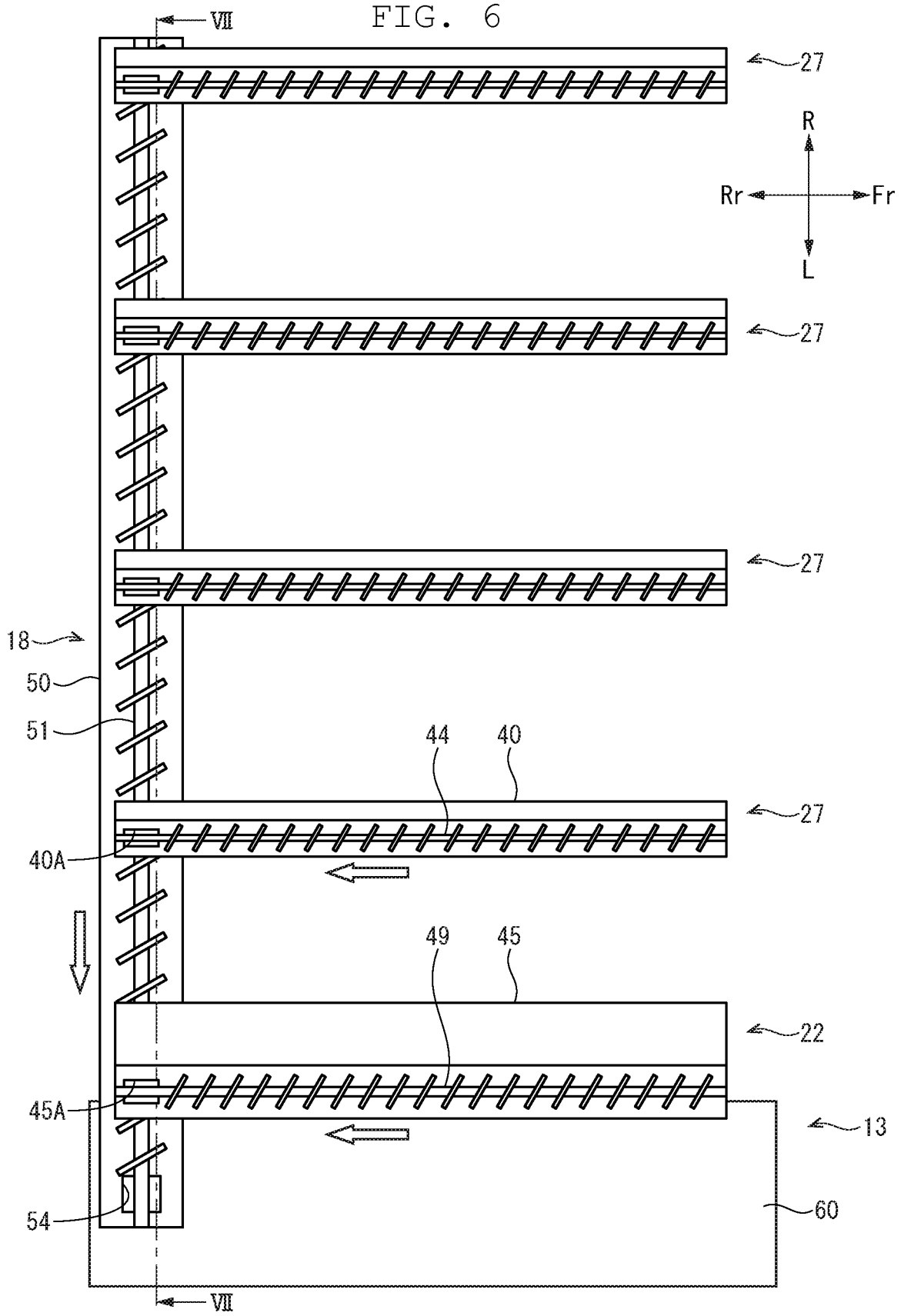
FIG. 6 is a plane sectional view schematically showing drum cleaning devices, a belt cleaning device and a discharge conveying device in the image forming apparatus according to the first embodiment of the present disclosure.
Figure 7:
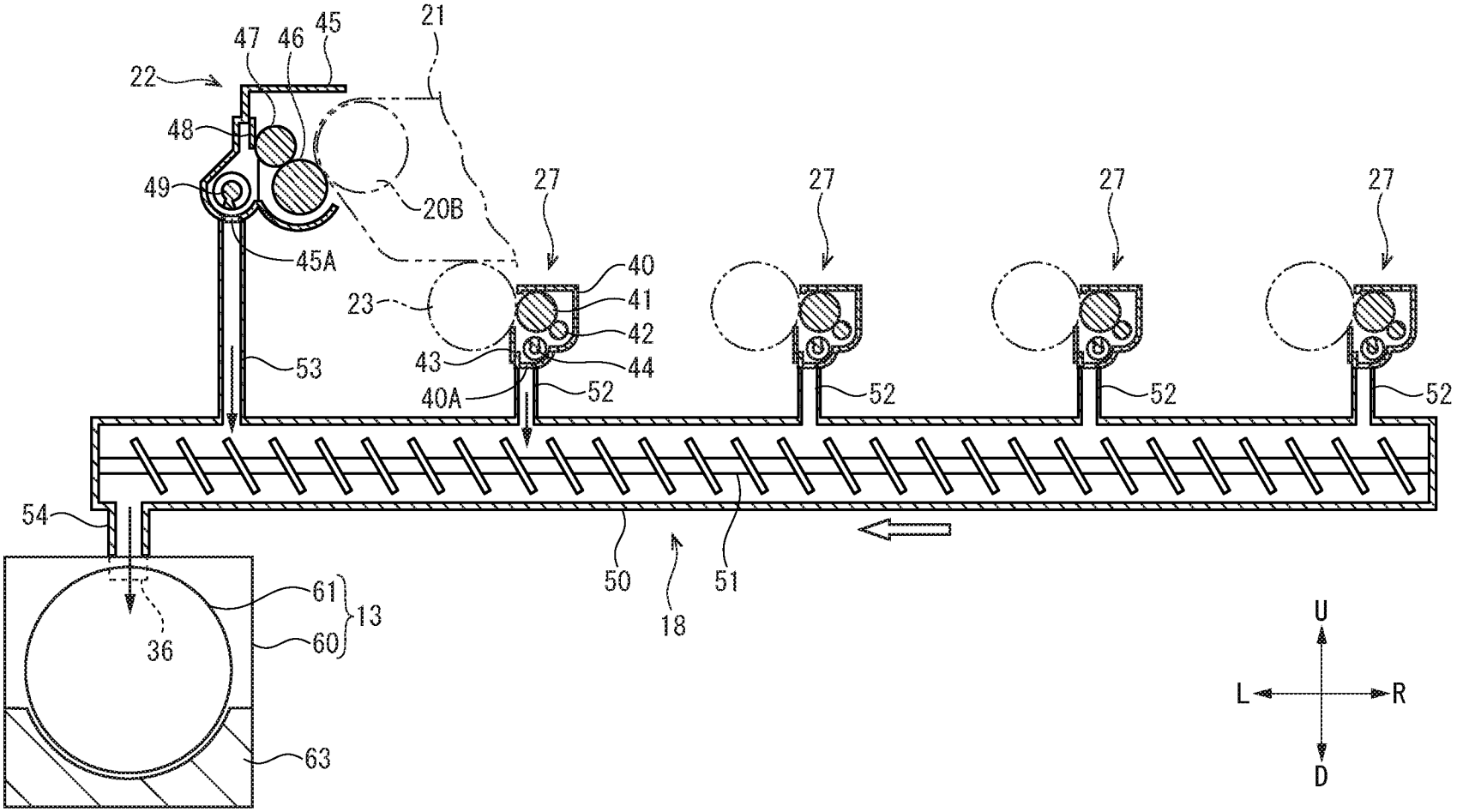
FIG. 7 is a sectional view taken along VII-VII line of FIG. 6.

Next, with reference to FIGS. 6 and 7, the four drum cleaning devices 27 and the belt cleaning device 22 will be described. FIG. 6 is a plane sectional view schematically showing the drum cleaning devices 27, the belt cleaning 22 device and the discharge conveying device 18. FIG. 7 is a sectional view taken along VII-VII line of FIG. 6.

<Drum Cleaning Device>

The four drum cleaning devices 27 are arranged so as to correspond to the four photosensitive drums 23 (referring to FIG. 1). Incidentally, because the four drum cleaning devices 27 have the same configuration, one drum cleaning device 27 will be described hereinafter.

As shown in FIG. 7, the drum cleaning device 27 includes a drum side housing 40, a grinding roller 41, a regulating roller 42, a cleaning blade 43 and a drum side screw 44.

As shown in FIGS. 6 and 7, the drum side housing 40 is formed in a roughly box shape having an opening in a face facing to the photosensitive drum 23. In a rear bottom face of the drum side housing 40, a drum side discharging port 40A connected to the discharge conveying device 18 described later is opened. The grinding roller 41 and the regulating roller 42 are formed in a roughly cylindrical shape lengthened in the forward and backward directions and supported rotatably around an axis inside the drum side housing 40. The grinding roller 41 comes into contact with the photosensitive drum 23, and the regulating roller 42 comes into contact with a right lower side of the grinding roller 41. The cleaning blade 43 is made of, for example, synthetic resin and formed in a plate shape, and fixed to the drum side housing 40. A distal end of the cleaning blade 43 comes into contact with the photosensitive drum 23. The drum side screw 44 has a helical blade fixed on a circumference face of a shaft extended in the forward and backward directions and supported rotatably around an axis inside the drum side housing 40. The drum side screw 44 is arranged at a left lower portion of the drum side housing 40.

<Belt Cleaning Device>

As shown in FIG. 7, the belt cleaning device 22 includes a belt side housing 45, a bias brush 46, a collecting roller 47, a collecting blade 48 and a belt side screw 49.

As shown in FIGS. 6 and 7, the belt side housing 45 is formed in a roughly box shape having an opening in a face facing to the intermediate transferring belt 21. In a rear bottom face of the belt side housing 45, a belt side discharging port 45A connected to the discharge conveying device 18 described later is opened. The bias brush 46 and the collecting roller 47 are formed in a roughly cylindrical shape lengthened in the forward and backward directions and supported rotatably around an axis inside the belt side housing 45. The bias brush 46 comes into contact with the intermediate transferring belt 21, and the collecting roller 47 comes into contact with a left upper side of the bias brush 46. The collecting blade 48 is made of, for example, synthetic resin and formed in a plate shape, and fixed to the belt side housing 45. A distal end of the collecting blade 48 comes into contact with the collecting roller 47. The belt side screw 49 has a helical blade fixed on a circumference face of a shaft extended in the forward and backward directions and supported rotatably around an axis inside the belt side housing 45. The belt side screw 49 is arranged at a left lower portion of the belt side housing 45.

<Discharge Conveying Device>

As shown in FIGS. 6 and 7, the four drum cleaning devices 27 and the belt cleaning device 22 are connected to the discharge conveying device 18 conveying the waste toner to the waste toner collecting device 13. The discharge conveying device 18 includes a conveying housing 50 and a conveying screw 51.

The conveying housing 50 is formed in a roughly rectangular parallelepiped shape lengthened in the left and right directions. In an upper face of the conveying housing 50, four drum side introducing tubes 52 and a belt side introducing tube 53 are arranged in parallel in the left and right directions. Each drum side introducing tube 52 is connected to the drum side discharging port 40A of the drum cleaning device 27. The belt side introducing tube 53 is connected to the belt side discharging port 45A of the drum cleaning device 27. In a left bottom face of the conveying housing 50, a conveyance discharging tube 54 connected to the waste toner collecting device 13. The conveying screw 51 has a helical blade fixed on a circumference face of a shaft extended in the left and right directions and supported rotatably around an axis inside the conveying housing 50.

<Waste Toner Collecting Device>

Figure 8:
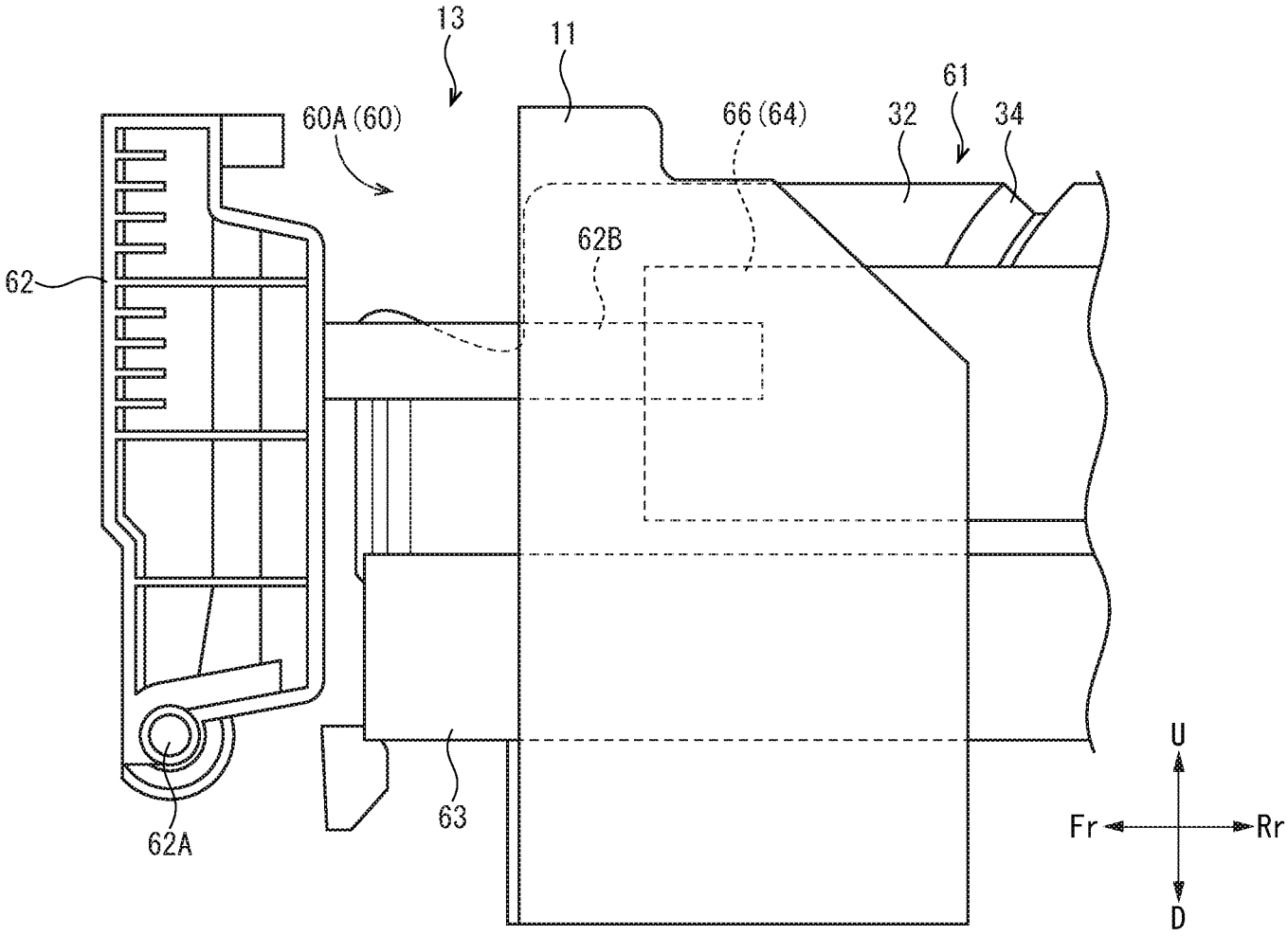
FIG. 8 is a side view showing a front part of the waste toner collecting device, in a state of closing a collecting cover, in the image forming apparatus according to the first embodiment of the present disclosure.
Figure 9:
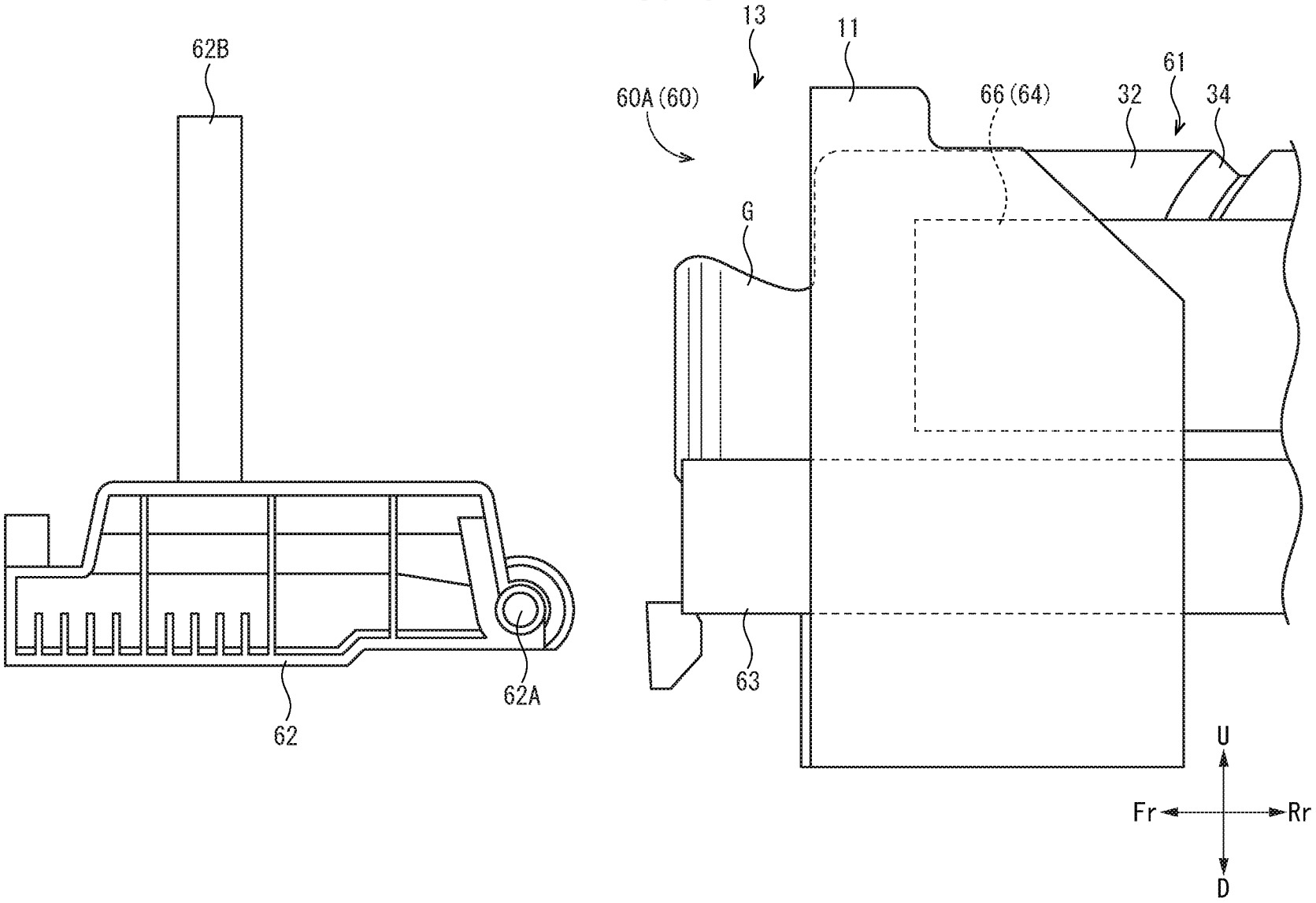
FIG. 9 is a side view showing the front part of the waste toner collecting device, in a state of opening the collecting cover, in the image forming apparatus according to the first embodiment of the present disclosure.
Figure 10:
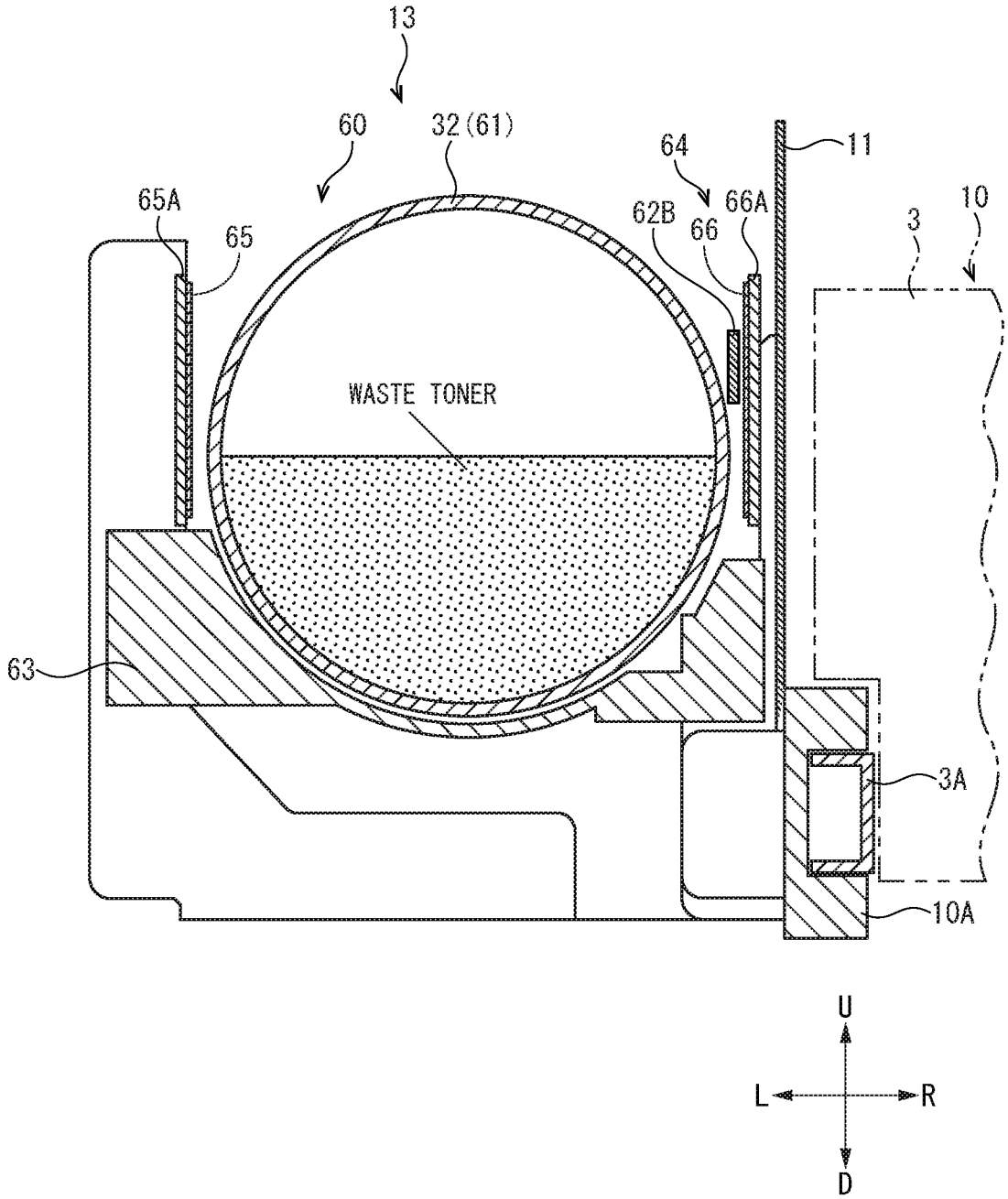
FIG. 10 is a sectional view taken along X-X line of FIG. 2.

Next, with reference to FIGS. 2, 3 and 7-10, the waste toner collecting device 13 as an example of a container attachment device will be described. FIG. 8 is a side view showing a front part of the waste toner collecting device 13 in a state of closing the collecting cover 62. FIG. 9 is a side view showing the front part of the waste toner collecting device 13, in a state of opening the collecting cover 62. FIG. 10 is a sectional view taken along X-X line of FIG. 2.

As shown in FIGS. 2 and 3, the waste toner collecting device 13 includes a collecting side attached part 60 (attached part) and the collecting bottle 61. To the collecting side attached part 60, the collecting bottle 61 is attached detachably. In the collecting bottle 61 (the container body 32), the waste toner discharged from the belt cleaning device 22 or the drum cleaning device 27 is stored.

«Collecting Bottle»

The collecting bottle 61 as an example of a toner container is the toner bottle 31 emptied by consuming the replenishing toner (any one of the four toner bottles 31) (referring to FIG. 5). That is, the emptied toner bottle 31 is used in common (reused) as the collecting bottle 61 collecting the waste toner. Because the collecting bottle has the same configuration as the toner bottle 31 already described, detail description of the collecting bottle 61 is omitted. Moreover, references indicating components of the collecting bottle 61 are the same as references indicating components of the toner bottle 31. Incidentally, although an example that the emptied toner bottle 31 is used as the collecting bottle 61 was described, the present disclosure is not restricted by this example, and the exclusive collecting bottle 61 different from the toner bottle 31 may be prepared.

«Collecting Side Attached Part»

The collecting side attached part 60 is arranged adjacent to the left side of the cartridge attached part 10 (referring to FIG. 2). The collecting side attached part is located at a position corresponding to the conveyance discharging tube 54 of the discharge conveying device 18 (referring to FIGS. 6 and 7). The collecting side attached part 60 constitutes a space to which the collecting bottle 61. In a lower front face of the apparatus body 2, a collecting side opening 60A of the collecting side attached part 60 is formed in order to attach or detach the collecting bottle 61.

The collecting side attached part 60 includes the collecting cover 62, a supporting rail part 63 and a displacement sensor 64. The collecting cover 62 is provided in order to open or close the collecting side opening 60A of the collecting side attached part 60. The supporting rail part 63 supports the collecting bottle 61 slidably. The displacement sensor 64 detects electrostatic capacity according to the waste toner stored in the collecting bottle 61.

«<Collecting Cover>»

As shown in FIGS. 8 and 9, the collecting cover 62 is made of, for example, synthetic resin, and a lower portion of the collecting cover 62 is connected to the collecting side attached part 60 (or the apparatus body 2) via a rotating shaft 62A extended in both left and right sides. The collecting cover 62 is provided so as to turn around the rotating shaft 62A. Moreover, to the right side of a rear face of the collecting cover 62, an actuator 62B is fixed (referring to FIGS. 2 and 3). The actuator 62B is made of, for example, synthetic resin and formed in a rectangular plate shape, and is provided in a posture orthogonal to the collecting cover 62

(referring to FIGS. 8 and 9). As described later in detail, in a condition that the collecting cover 62 closes the collecting side opening 60A, a distal end of the actuator 62B is inserted between the collecting bottle 61 and the displacement sensor 64 (referring to FIG. 10). Incidentally, the actuator 62B may be formed together with the collecting cover 62 in a body, or may be constituted by separate member. Moreover, the actuator 62B is not restricted by synthetic resin, and may be made of metal.

«<Supporting Rail Part>»

The supporting rail part 63 is arranged in a lower portion of the collecting side attached part 60, and an upper face of the supporting rail part 63 is recessed according to a circumference face of the container body 32. The supporting rail part 63 supports the container body 32 slidably in an axial direction and rotatably around an axis.

<Attaching of Collecting Bottle>

Hereupon, procedure attaching the collecting bottle 61 to the collecting side attached part 60 will be described. The user opens the collecting cover 62 to expose the collecting side attached part 60, and inserts the collecting bottle 61 (the emptied toner bottle 31) into the collecting side attached part 60 in a state that the grip part G is directed to the front side and the communicating port 36 is directed to the upper side. In process inserting the collecting bottle 61, the shutter is slid relatively forward by coming into contact with a part of the collecting side attached part 60 to open the communicating port 36. The opened communicating port 36 is connected to a downstream end of the conveyance discharging tube 54 (referring to FIG. 7). After that, the user closes the collecting cover 62.

By the above-described procedure, attaching of the collecting bottle 61 is completed (referring to FIGS. 2 and 3). In this condition, the collecting side attached part 60 fixes the cap 33 and supports the container body rotatably. Moreover, in this condition, the transmitting gear 35 is connected to the driving motor M (referring to FIG. 5) via the power transmitting mechanism, and the communicating port 36 is connected to the respective cleaning devices 22 and 27 via the discharge conveying device 18 (referring to FIG. 7). Incidentally, even if the collecting bottle 61 is not appropriately attached to the collecting side attached part 60, it is configured so that the collecting cover 62 does not appropriately close by interference of the grip part G. That is, in a condition that the collecting cover 62 is not closed, the transmitting gear 35 is not connected to the driving motor M.

<Removing of Waste Toner>

Next, removing operation of the waste toner (the residual toner) will be described. Incidentally, to the bias brush 46 and the respective screw 44, 49 and 51, negative bias have been applied.

When the image forming process is performed, the grinding roller 41 and the regulating roller 42 are rotated by following to the photosensitive drum 23, the drum side screw 44 is driven and rotated by a motor (not shown). Incidentally, to a surface of the grinding roller 41, the waste toner (the residual toner) remained on the surface of the photosensitive drum 23 is adhered and a toner layer is formed. The grinding roller 41 grinds the surface of the photosensitive drum 23 via the toner layer. The regulating roller 42 makes layer thickness of the toner layer uniform. The cleaning blade 43 scrapes the waste toner adhered on the surface of the photosensitive drum 23, and the waste toner is stored in the drum side housing 40. The drum side screw 44 is driven and rotated by a motor to convey the waste toner stored in the drum side housing 40 toward the drum side discharging port 40A (referring to an arrow in FIG. 6). The waste toner is discharged from the drum side discharging port 40A and introduced in the conveying housing 50 via the drum side introducing tube 52 (referring to an arrow in FIG. 7).

Moreover, the bias brush 46, the collecting roller 47 and the belt side screw 49 are driven and rotated by a motor. The bias brush 46 absorbs the waste toner (the residual toner) adhered on the surface of the intermediate transferring belt 21 by electrostatic absorption force. The collecting roller 47 receives the waste toner moved to the bias brush 46. The collecting blade 48 scrapes the waste toner moved to the collecting roller 47, and the waste toner is stored in the belt side housing 45. The belt side screw 49 is driven and rotated by a motor to convey the waste toner stored in the belt side housing 45 toward the belt side discharging port 45A (referring to an arrow in FIG. 6). The waste toner is discharged from the belt side discharging port 45A and introduced in the conveying housing 50 via the belt side introducing tube 53.

The conveying screw 51 is driven and rotated by a motor to convey the waste toner introduced in the conveying housing 50 toward the conveyance discharging tube 54 (referring to an arrow in FIG. 6). The waste toner introduced in the conveying housing 50 is introduced in the cap 33 (the collecting bottle 61) from the communicating port 36 through the conveyance discharging tube 54 (referring to an arrow in FIG. 7).

The container body 32 (the conveying rib 34) attached to the collecting side attached part 60 is driven by the driving motor M and rotated around an axis (in an opposite direction to the container body 32 attached to the replenishing side attached part 30). When the container body 32 (the conveying rib 34) is rotated around the axis, the waste toner introduced from the communicating port 36 to the inside of the container body 32 is conveyed from the rear side to the front side (the other side in the axial direction). The conveying rib 34 conveys the waste toner to the front side and makes a surface (an upper face) of the stored waste toner uniform.

As described above, the waste toner is collected in the collecting bottle 61 (the container body 32) (referring to FIG. 10).

«<Displacement Sensor>»

As shown in FIGS. 2, 3 and 8-10, in the collecting side attached part 60, the displacement sensor 64 detecting an accumulation quantity (a storage quantity) of the waste toner stored in the collecting bottle 61 is provided. The displacement sensor 64 is an electrostatic capacity sensor arranged to face to the collecting bottle 61 attached to the collecting side attached part 60 to detect electrostatic capacity varying in accordance with the accumulation quantity of the waste toner stored in the collecting bottle 61. In detail, the displacement sensor is an electrostatic capacity sensor in a mutual capacity manner detecting electric field change between a transmitting electrode 65 and a receiving electrode 66 arranged to face to each other across the collecting bottle 61. Incidentally, as an example, the displacement sensor 64 can detect the accumulation quantity of the waste toner by 0-100% with regard to capacity of the collecting bottle 61. However, the present disclosure is not restricted by this example, detectable range of the accumulation quantity may be freely defined.

As shown in FIGS. 3 and 10, the transmitting electrode 65 and the receiving electrode 66 are respectively mounted on rectangular substrates 65A and 66A lengthened in the forward and backward directions. The substrates 65A and 66A are provided in standing postures along the forward and backward directions and fixed to a frame (not shown) of the collecting side attached part 60. The transmitting electrode 65 and the receiving electrode (the substrates 65A and 66A) are arranged above the supporting rail part 63. In addition, the transmitting electrode 65 and the receiving electrode 66 are arranged above the cartridge rails 10A and the slide guides 3A. The transmitting electrode 65 and the receiving electrode 66 are formed on faces of the substrates 65A and 66A at sides of the container body 32. The transmitting electrode 65 is arranged at an opposite side to the cartridge attached part 10 (at the left side of the apparatus body 2) across the collecting bottle 61. The receiving electrode 66 is arranged at a side of the cartridge attached part 10 (the sheet feeding cartridge 3). The transmitting electrode 65 and the receiving electrode 66 are electrically connected to the controlling part 17.

The collecting bottle 61, the transmitting electrode 65 and the receiving electrode 66 are arranged in roughly parallel to the rail holding members 11 (the cartridge rails 10A) (referring to FIG. 2). The transmitting electrode 65 and the receiving electrode 66 are arranged at positions not connecting to the container body 32 at the front side of the container body 32 (the other side from the center in the axial direction). The receiving electrode 66 is arranged between the container body 32 and the rail holding members 11 (as viewed from the front side). In addition, the receiving electrode 66 (the substrate 66A) is arranged to not connect to the rail holding members 11 and to face to the rail holding members 11. Exactly, a front portion (a part) of the receiving electrode 66 is overlapped with the rail holding members 11 provided unmovably.

As the accumulation quantity of the waste toner in the collecting bottle 61 is increased, electric field (electrostatic capacity) between the transmitting electrode 65 and the receiving electrode 66 is changed. The controlling part 17 receives an output (detecting result) from the displacement sensor 64 at regular intervals to decide the accumulation quantity of the waste toner in the collecting bottle 61.

Moreover, the displacement sensor 64 can detect an attaching/detaching state of the collecting bottle 61 to the collecting side attached part 60 and an opening/closing state of the collecting cover 62 in addition to the accumulation quantity of the waste toner in the collecting bottle 61.

Because the displacement sensor 64 faces to the collecting bottle 61 (the container body 32) attached to the collecting side attached part 60, the electric field (the electrostatic capacity) between the transmitting electrode 65 and the receiving electrode 66 is changed in accordance with presence/absence of the collecting bottle 61 in the collecting side attached part 60. Incidentally, the collecting bottle 61 may be empty or stores the waste toner.

Moreover, as shown in FIG. 8, in a condition that the collecting cover 62 closes the collecting side opening 60A, the distal end of the actuator 62B is arranged to face to the receiving electrode 66 of the displacement sensor 64. As shown in FIG. 9, in a condition that the collecting cover 62 opens the collecting side opening 60A, the actuator 62B is moved away from a position facing to the displacement sensor 64. Therefore, in accordance with presence/absence of the actuator 62B, the electric field (the electrostatic capacity) between the transmitting electrode 65 and the receiving electrode 66 is changed.

Figure 11:
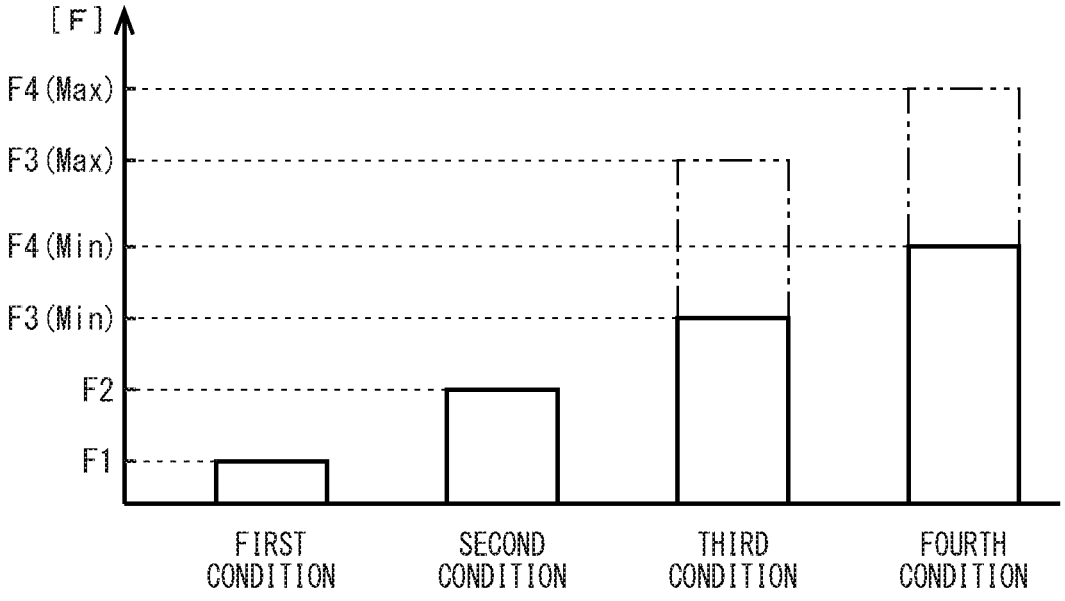
FIG. 11 is a graph plotting electrostatic capacities detected in first to fourth conditions by a displacement sensor of the waste toner collecting device according to the first embodiment of the present disclosure.

Next with reference to FIG. 11, conditions which can be detected by the displacement sensor 64 will be described. FIG. 11 is a graph plotting electrostatic capacities detected in first to fourth conditions by the displacement sensor 64. Incidentally, values of the electrostatic capacities shown in FIG. 11 are values for explanation, but do not always indicate correct values.

The displacement sensor 64 detects the electrostatic capacity varying in accordance with the storage quantity of the waste toner stored in the collecting bottle 61, attaching/detaching of the collecting bottle 61 and opening/closing of the collecting cover 62. Concretely, the displacement sensor 64 detects the electrostatic capacity varying among the first to fourth conditions. The first condition is a condition that the collecting cover 62 is opened and the collecting bottle 61 is detached from the collecting side attached part 60. The second condition is a condition that the collecting cover 62 is closed and the collecting bottle 61 is detached from the collecting side attached part 60. The first condition is a condition that the collecting cover 62 is opened and the collecting bottle 61 is attached to the collecting side attached part 60. The first condition is a condition that the collecting cover 62 is closed and the collecting bottle 61 is attached to the collecting side attached part 60. Moreover, the displacement sensor 64 detects the electrostatic capacity varying in accordance with the accumulation quantity of the waste toner stored in the collecting bottle 61 in the third and fourth conditions.

In the first condition, the displacement sensor 64 detects a first electrostatic capacity F1 corresponding to dielectric constant of an air in the collecting side attached part 60. In the second condition, because the actuator 62B faces to the receiving electrode 66, the displacement sensor 64 detects a second electrostatic capacity F2 corresponding to dielectric constant of the actuator 62B (synthetic resin). In the third condition, because the container body 32 of the collecting bottle 61 faces to the receiving electrode 66, the displacement sensor 64 detects a third electrostatic capacity F3 corresponding to a total of dielectric constants of the container body 32 (synthetic resin) and the waste toner in the container body 32. In the fourth condition, because the actuator 62B and the container body 32 face to the receiving electrode 66, the displacement sensor 64 detects a fourth electrostatic capacity F4 corresponding to a total of dielectric constants of the actuator 62B, the container body 32 and the waste toner in the container body 32.

The first electrostatic capacity F1 and the second electrostatic capacity F2 are roughly constants. The third electrostatic capacity F3 and the fourth electrostatic capacity F4 may be varied in accordance with the accumulation quantity (0-100% of an accumulation rate) of the waste toner stored in the collecting bottle 61. Therefore, the third condition and the fourth condition are conditions having predetermined ranges (minimum to maximum values).

The second electrostatic capacity F2 is a larger value than the first electrostatic capacity F1, the minimum value (Min) of the third electrostatic capacity F3 is a larger value than the second electrostatic capacity F2, and the minimum value (Min) of the fourth electrostatic capacity F4 is a larger value than the minimum value (Min) of the third electrostatic capacity F3 ($F1<F2<F3(Min)<F4(Min)$). In a memory (not shown) of the controlling part 17, the first and second electrostatic capacities F1 and F2 and the minimum values (Min) of the third and fourth electrostatic capacities F3 and F4 are stored in advance. Incidentally, the minimum values (Min) of the third and fourth electrostatic capacities F3 and F4 are electrostatic capacities corresponding to the emptied collecting bottle 61 (0% of the accumulation rate), and the maximum values (Max) of the third and fourth electrostatic capacities F3 and F4 are electrostatic capacities corresponding to the full collecting bottle 61 (100% of the accumulation rate).

Incidentally, it is feared that the output of the displacement sensor 64 is varied in accordance with attaching/detaching of the adjacent sheet feeding cartridge 3 and the displacement sensor 64 does not detect correct electrostatic capacity. However, since the rail holding member 11 covers the receiving electrode 66, even if the sheet feeding cartridge 3 is attached/detached, a distance of the receiving electrode 66 and the rail holding member 11 is kept constant, and varying of the electrostatic capacity detected by the displacement sensor is restrained. Thereby, it is possible to detect correct electrostatic capacity.

<Detecting of Electrostatic Capacity>

Next, detecting of the electrostatic capacity in each condition by using the displacement sensor 64 will be described. The controlling part 17 receives an output (detecting result) from the displacement sensor 64 at regular intervals. Incidentally, the interval (a sampling rate) receiving the output from the displacement sensor 64 may be freely defined.

In a case where the detecting result is the first electrostatic capacity F1, the controlling part 17 decides the first condition, and displays, for example, a message or the like indicating opening of the collecting cover 62 and not-attaching of the collecting bottle 61 on the touch panel (not shown) provided in the image forming apparatus 1. In a case where the detecting result is the second electrostatic capacity F2, the controlling part 17 decides the second condition, and displays, for example, a message or the like indicating not-attaching of the collecting bottle 61 on the touch panel. In a case where the detecting result is the minimum (Min) of the third electrostatic capacity F3, the controlling part 17 decides the third condition and that the emptied collecting bottle 61 is attached and the collecting cover 62 is forgotten to close, and displays, for example, a message or the like encouraging closing of the collecting cover 62 on the touch panel. Incidentally, in a case where the controlling part 17 decides any of the first to third conditions, the controlling part 17 restrict performing of the image forming process.

In a case where the detecting result is the minimum (Min) of the fourth electrostatic capacity F4, the controlling part 17 decides the fourth condition and that the emptied collecting bottle 61 is attached and the collecting cover 62 is closed, and allows performing of the image forming process. While or after performing of the image forming process, the controlling part 17 receives the detecting result from the displacement sensor at regular intervals and calculates the accumulation quantity of the waste toner stored in the collecting bottle 61. In a case where the detecting result is the maximum (Max) of the fourth electrostatic capacity F4, the controlling part 17 decides that the collecting bottle 61 becomes full, and promptly stops image forming operation. Moreover, the controlling part 17 displays, for example, a message or the like indicating full of the collecting bottle 61 or encouraging replacement of the collecting bottle 61 on the touch panel.

In a case replacing the full collecting bottle 61, the user opens the collecting cover 62, grasps the grip part G and pulls the collecting bottle 61 out to the front side, and thereby, detaches the collecting bottle 61 from the collecting side attached part 60. According to pulling-out of the collecting bottle 61, the shutter is biased backward by a spring (not shown) to close the communicating port 36.

Incidentally, for example, in a case where the waste toner is stored in the collecting bottle 61 and others, because the third electrostatic capacity F3 has an overlapped range with the fourth electrostatic capacity F4, the controlling part 17 may not decide the condition by only a level of the electrostatic capacity. However, when the condition is shifted between the third condition and the fourth condition, since the electrostatic capacity (an electrostatic capacity corresponding to presence/absence of the actuator 62B) is significantly increased/decreased in a moment, the controlling part 17 can decide shifting between the third condition and the fourth condition by referring to varying a quantity of the electrostatic capacity within a predetermined time. Moreover, in a case where the controlling part 17 cannot decide the condition, the controlling part 17 displays, for example, a message indicating that on the touch panel.

In the waste toner collecting device 13 (the container attachment device) according to the above-described first embodiment, it is configured that the collecting bottle 61 attached to the collecting side attached part 60 faces to the displacement sensor 64, the actuator 62B faces to the displacement sensor 64 in a condition closing the collecting cover 62 but does not faces to the displacement sensor 64 in a condition opening the collecting cover 62. In such a configuration, by the displacement sensor 64 detecting the accumulation quantity of the waste toner stored in the collecting bottle 61, it is possible to detect the electrostatic capacity according to presence/absence of the collecting bottle 61 and the electrostatic capacity according to presence/absence of the actuator 62B. That is, it is possible to detect the accumulation quantity of the waste toner (sensing of full), attaching/detaching of the collecting bottle 61 and opening/closing of the collecting cover 62 by one displacement sensor 64. Thereby, in comparison with a case detecting the accumulation quantity of the waste toner, opening/closing of the collecting cover 62 and others by several sensors, it is possible to simplify the configuration of the waste toner collecting device 13 and to reduce manufacturing cost.

Moreover, in the third condition, there is a case that the collecting bottle 61 is not appropriately attached to the collecting side attached part 60 and the transmitting gear 35 is not connected to the motor M. In the first embodiment, because the collecting cover 62 cannot be closed if the collecting bottle 61 is not appropriately attached to the collecting side attached part 60, in a case where the controlling part 17 detect the fourth condition (a condition closing the collecting cover 62), it is estimated that the collecting bottle 61 is not appropriately attached to the collecting side attached part 60. That is, it is possible to detect that the transmitting gear 35 is appropriately connected to the motor M. Thereby, it is possible to prevent the image forming process from being performed regardless of irregular of connecting of the transmitting gear 35 and the motor M.

Moreover, in accordance with the waste toner collecting device 13 according to the first embodiment, since the actuator 62B faces to the receiving electrode 66 or separates from the receiving electrode 66 according to opening/closing of the collecting cover 62, it is possible to detect various electrostatic capacity by the displacement sensor 64. Thereby, it is possible to use the displacement sensor 64 detecting the accumulation quantity of the waste toner in common for sensing of opening/closing of the collecting cover 62. When sensing of opening/closing of the collecting cover 62 is performed, it is possible to prevent forgetting to close the collecting cover 62 and to secure regular driving connection.

Further, in accordance with the waste toner collecting device 13 according to the first embodiment, since the container body 32 formed in a cylindrical shape is rotated around an axis, a distance of the displacement sensor 64 and the container body 32 is not changed by rotation of the container body 32, and it is possible to keep this distance constant. Thereby, since the displacement sensor 64 can detect correct electrostatic capacity, it is possible to appropriately detect the accumulation quantity of the waste toner stored in the collecting bottle 61.

Incidentally, in the waste toner collecting device according to the first embodiment, as an example, although the front side of the receiving electrode 66 faces to the rail holding member 11, the present disclosure is not restricted by this example. A rear side of the receiving electrode 66 or the whole of the receiving electrode 66 may be arranged to face to the rail holding member 11 (not shown). Moreover, in the waste toner collecting device 13 according to the first embodiment, as an example, although the receiving electrode 66 of the displacement sensor 64 is arranged to face to the rail holding member 11, the present disclosure is not restricted by this example. The receiving electrode 66 and the transmitting electrode 65 may be replaced to each other and the transmitting electrode 65 may be arranged to face to the rail holding member 11 (not shown). That is, the rail holding member 11 may be arranged to face to at least a part of the displacement sensor 64. Further, n the waste toner collecting device according to the first embodiment, as an example, although the transmitting electrode 65 and the receiving electrode 66 are arranged to face to each other in the left and right directions, the present disclosure is not restricted by this example. The transmitting electrode 65 and the receiving electrode 66 may be arranged to face to each other in the upward and downward directions (not shown).

Second Embodiment

Figure 12:
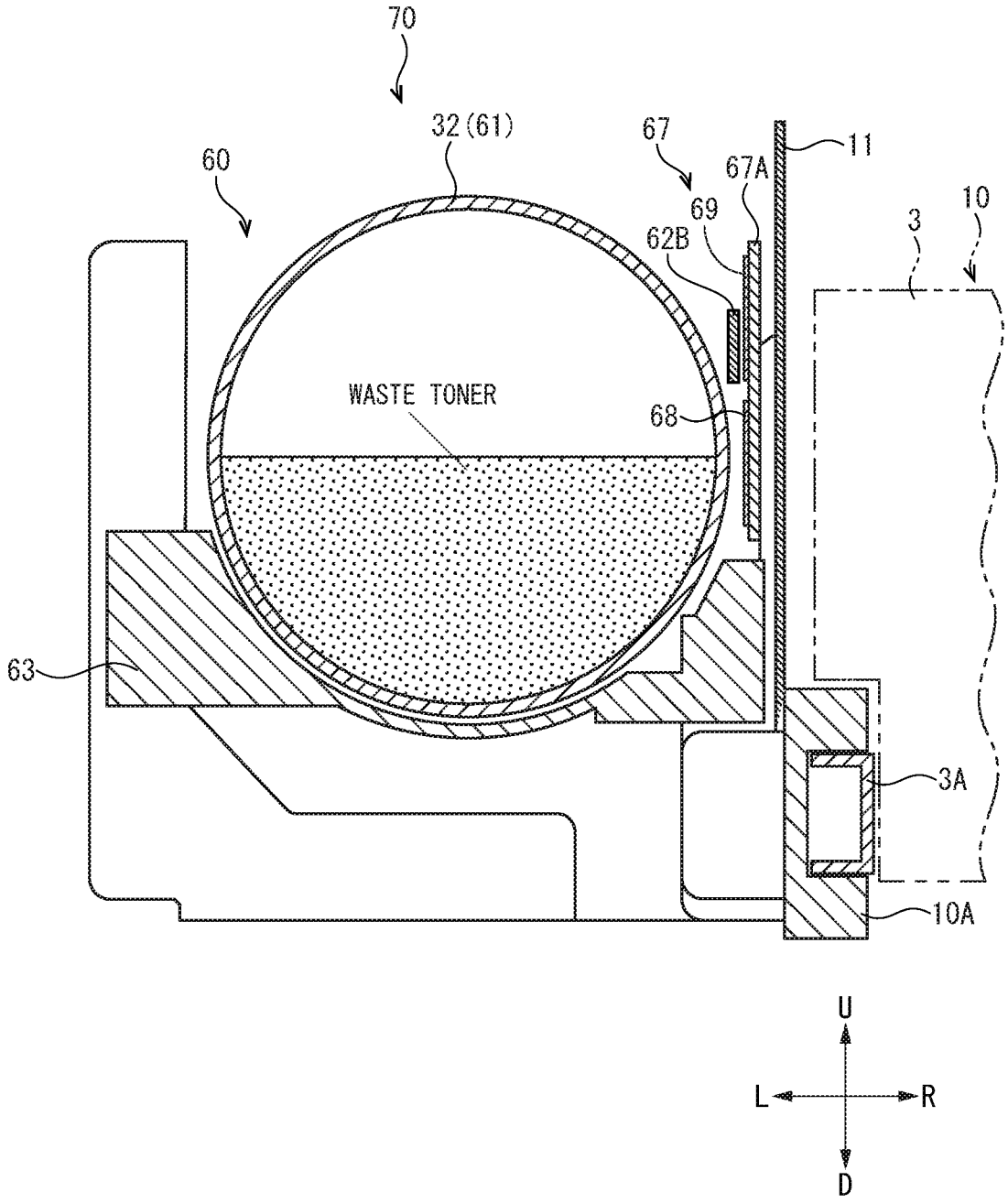
FIG. 12 is a front sectional view showing the waste toner collecting device and others according to a second embodiment of the present disclosure.

Next, with reference to FIG. 12, the waste toner collecting device 70 according to a second embodiment will be described. FIG. 12 is a front sectional view showing the waste toner collecting device 70 and others according to the second embodiment. Incidentally, in the following description, the same components of the waste toner collecting device 70 as the waste toner collecting device 13 according to the first embodiment are indicated by the same references as the first embodiment, and the same description of the waste toner collecting device 70 as the waste toner collecting device 13 according to the first embodiment is omitted.

In the waste toner collecting device 70 according to the second embodiment, the transmitting electrode 68 and the receiving electrode 69 of the displacement sensor 67 are mounted on one substrate 67A in parallel in the upward and downward directions. In FIG. 12, as an example, although, the transmitting electrode 68 is arranged at the lower side in the substrate 67A and the receiving electrode 69 is arranged at the upper side in the substrate 67A, arrangement of the transmitting electrode 68 and the receiving electrode 69 may be replaced in the upward and downward directions. the displacement sensor is an electrostatic capacity sensor in a mutual capacity manner detecting electric field change between the transmitting electrode 68 and the receiving electrode 69 arranged to face to a right side face of the collecting bottle 61 (between the collecting bottle 61 and the rail holding member 11). The transmitting and receiving electrodes 68 and 69 do not come into contact with the rail holding member 11 and front sides (parts) of the transmitting and receiving electrodes 68 and 69 are overlapped with the rail holding member 11. The actuator 62B (a part of the collecting cover 62) is arranged to face to the receiving electrode 69.

In accordance with the waste toner collecting device 70 according to the above-described second embodiment, it is possible to achieve the same operation and effect as the waste toner collecting device 13 according to the first embodiment, for example, it is possible to detect opening/closing of the collecting cover by using the displacement sensor 67 detecting the accumulation quantity of the waste toner.

Incidentally, in the waste toner collecting device 70 according to the above-described second embodiment, as an example, although the front sides of the transmitting and receiving electrodes 68 and 69 face to the rail holding member 11, the present disclosure is not restricted by this example. rear sides of the transmitting and receiving electrodes 68 and 69 or the whole of the transmitting and receiving electrodes 68 and 69 may be arranged to face to the rail holding member 11 (not shown). Alternatively, the transmitting electrode 68 or the receiving electrode 69 may be arranged to face to the rail holding member 11 (not shown). Moreover, the transmitting electrode 68 and the receiving electrode 69 may be mounted in parallel in the left and right directions on one substrate 67A (not shown).

Third Embodiment

Figure 13:
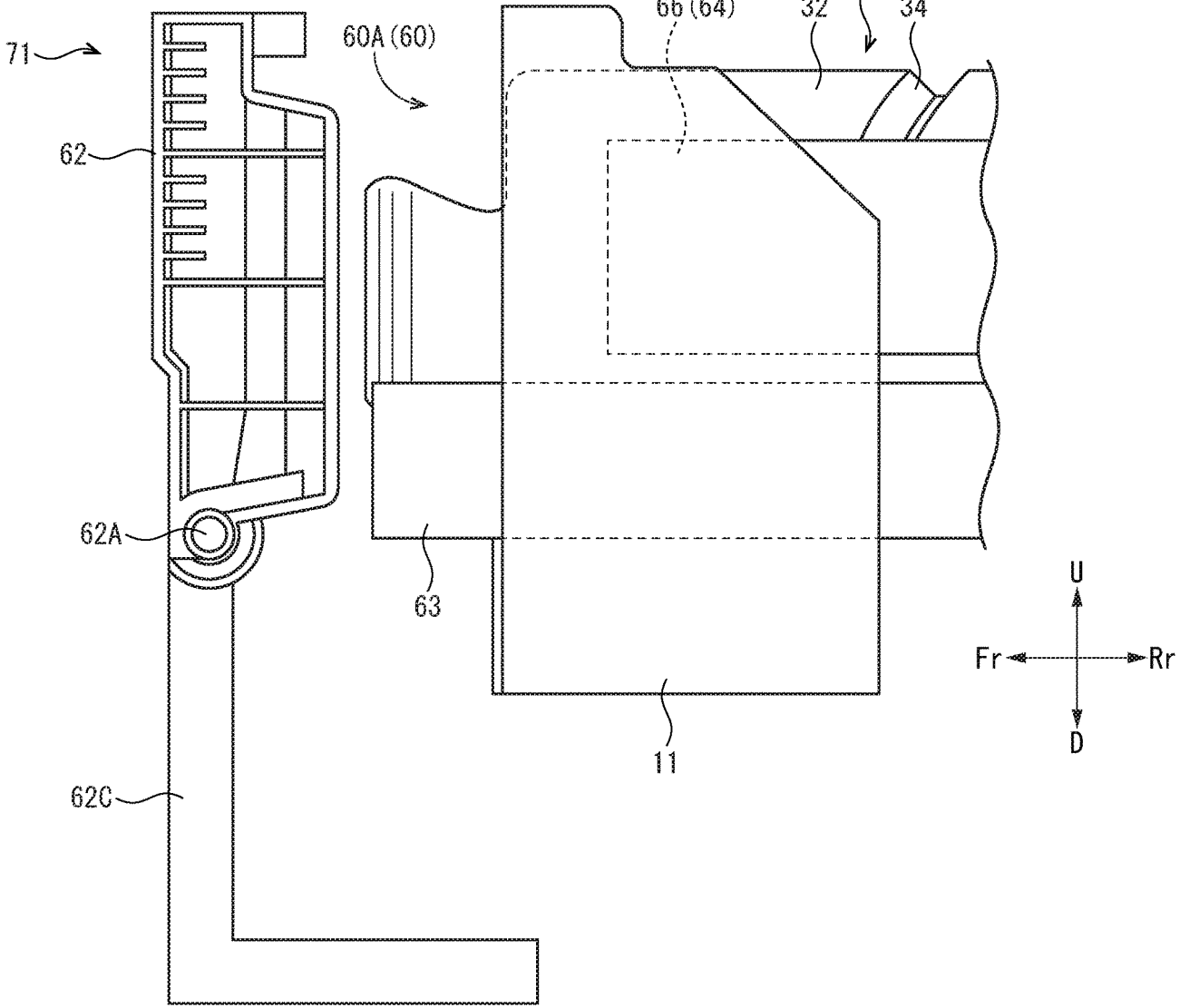
FIG. 13 is a side view showing the front part of the waste toner collecting device, in a state of closing the collecting cover, in the image forming apparatus according to a third embodiment of the present disclosure.
Figure 14:
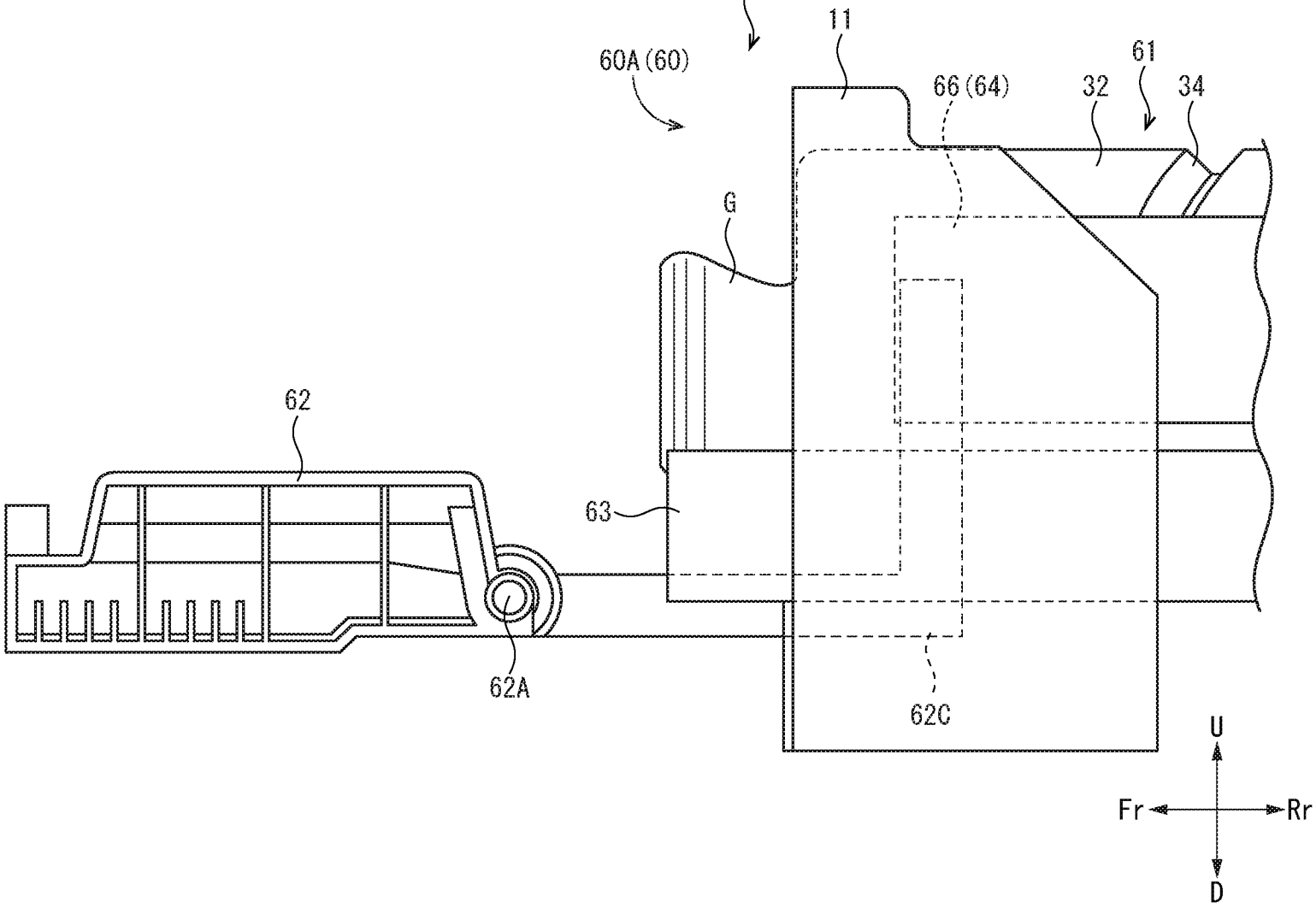
FIG. 14 is a side view showing the front part of the waste toner collecting device, in a state of opening the collecting cover, in the image forming apparatus according to the third embodiment of the present disclosure.

Next, with reference to FIGS. 13 and 14, the waste toner collecting device 71 according to a second embodiment will be described. FIG. 13 is a side view showing the front part of the waste toner collecting device 71, in a state of closing the collecting cover 62. FIG. 14 is a side view showing the front part of the waste toner collecting device 71, in a state of opening the collecting cover 62.

In the waste toner collecting device 71 according to the above-described third embodiment, an actuator 62C of the collecting cover 62 is formed in a roughly L-shaped plate shape (referring to FIG. 13). In a condition that the collecting cover 62 closes the collecting side opening 60A, the actuator 62C is extended from a lower portion of the collecting cover 62, bent at right angles and extended to the back side (referring to FIG. 13). In this condition, the actuator 62C is moved away from a position facing to the displacement sensor 64. On the other hand, in a condition that the collecting cover 62 opens the collecting side opening 60A, a distal end of the actuator 62C is arranged to face to the displacement sensor 64 (the receiving electrode 66) (referring to FIG. 14). That is, the distal end of the actuator 62C is inserted between the collecting bottle 61 and the displacement sensor 64.

In accordance with the waste toner collecting device 71 according to the above-described third embodiment, it is possible to achieve the same operation and effect as the waste toner collecting device 13 according to the first embodiment, for example, it is possible to detect opening/closing of the collecting cover by using the displacement sensor 67 detecting the accumulation quantity of the waste toner.

Incidentally, the actuator 62C of the waste toner collecting device 71 according to the third embodiment may be applied to the waste toner collecting device 70 according to the second embodiment.

Fourth Embodiment

In the above-described first to third embodiments, as an example, although features of the present disclosure is applied to the waste toner collecting device 13 so that the displacement sensor 64 or 67 for sensing of full is used in common for sensing of attaching/detaching of the collecting bottle 61 and sensing of opening/closing of the collecting cover 62, the present disclosure is not restricted by this example. As another example of the container attachment device, the features of the disclosure may be applied to the toner replenishing device (a fourth embodiment). Concretely, the residual quantity confirmation sensor for sensing a residual quantity of the toner bottle 31 (the replenishing toner) may be used in common for sensing of attaching/detaching of the toner bottle 31 and sensing of opening/closing of the replenishing cover 37. Incidentally, the features of the disclosure may be used for both of the toner replenishing device 12 and the waste toner collecting device 13. Moreover, the features of the waste toner collecting device 13, 70 or 71 according to the first to third embodiments may be applied to the toner replenishing device 12 according to the fourth embodiment.

Moreover, in the waste toner collecting device 13, 70 or 71 according to the first to third embodiments or the toner replenishing device 12 according to the fourth embodiment, as an example, although the actuator 62B or 62C faces to the receiving electrode 66 or 69, the present disclosure is not restricted by this example. For example, the actuator 62B or 62C may be provided to face to the transmitting electrode 65 or 68, or to face to both of the transmitting electrode 65 or 68 and the receiving electrode 66 or 69. Further, as an example, although the actuator 62B or 62C has a dimension facing to a part of the displacement sensor 64 or 67, the present disclosure is not restricted by this example. For example, the actuator 62B or 62C may be formed with a dimension covering the entire of the transmitting electrode 65 or 68 and/or the receiving electrode 66 or 69. Furthermore, a shape of the actuator 62B or 62C is not restricted by a rectangular shape or a L-shape, and may be formed in any of various shapes.

Moreover, in the waste toner collecting device 13, 70 or 71 according to the first to third embodiments or the toner replenishing device 12 according to the fourth embodiment, as an example, although the actuator 62B or 62C is applied to a part of the collecting cover 62, the present disclosure is not restricted by this example. For example, if the displacement sensor 64 or 67 is arranged at a position capable of detect a part of the collecting cover 62 except for the actuator 62B or 62C, the actuator 62B or 62C may be omitted (removed).

Fifth Embodiment

Figure 15:
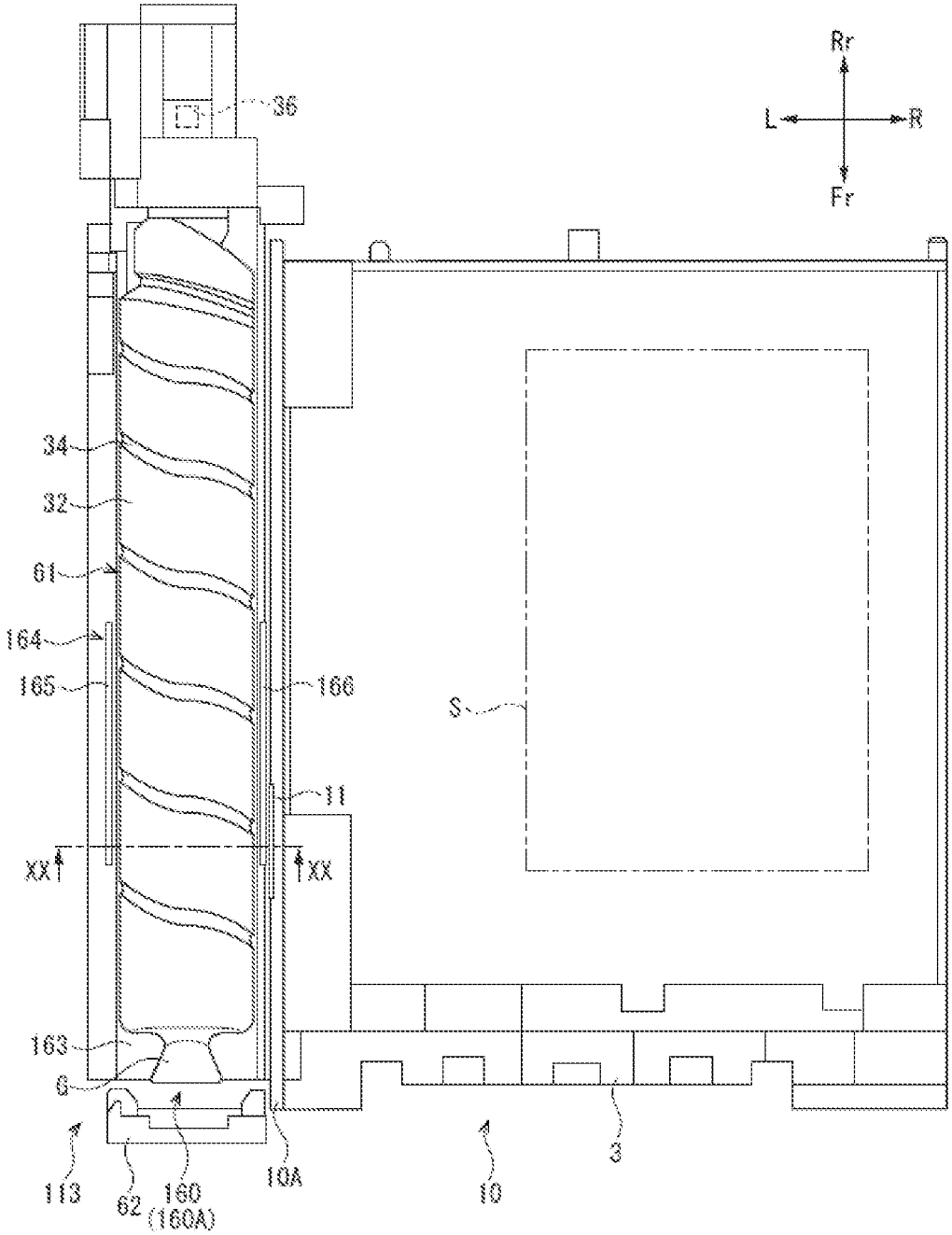
FIG. 15 is a plane view showing the sheet feeding cartridge, the waste toner collecting device and others in the image forming apparatus according to a fifth embodiment of the present disclosure.
Figure 16:
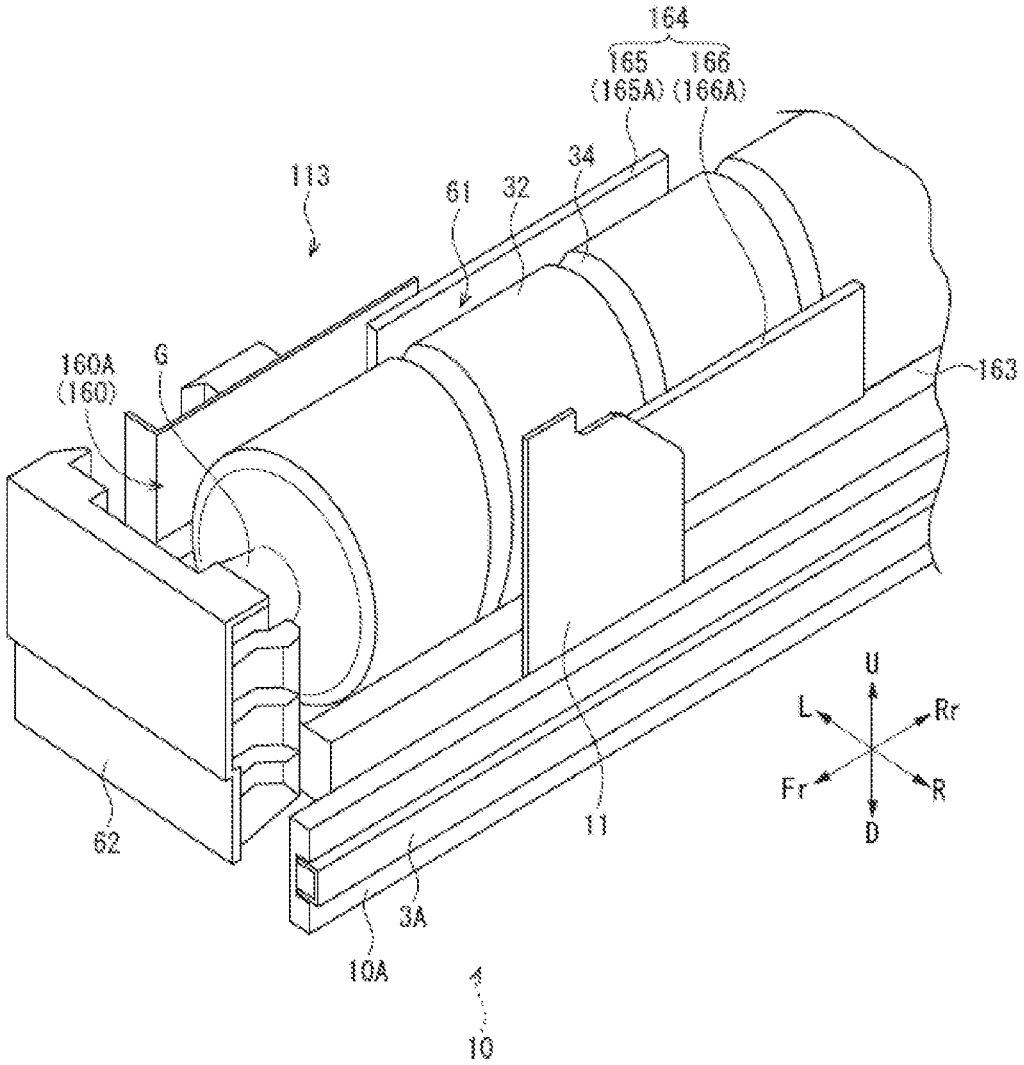
FIG. 16 is a perspective view showing a front periphery of the waste toner collecting device according to the fifth embodiment of the present disclosure.
Figure 18:
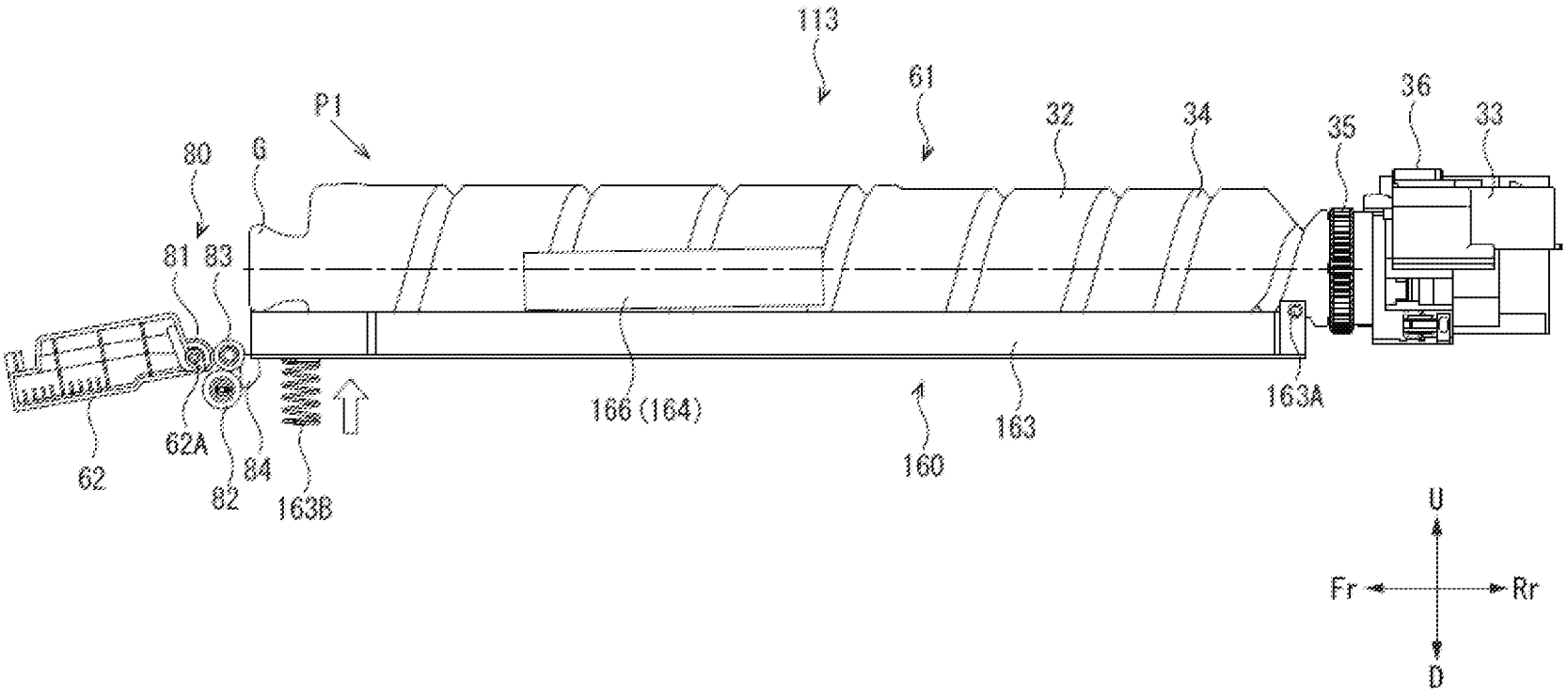
FIG. 18 is a side view showing the a collecting bottle in a first posture in the waste toner collecting device according to the fifth embodiment of the present disclosure.
Figure 19:
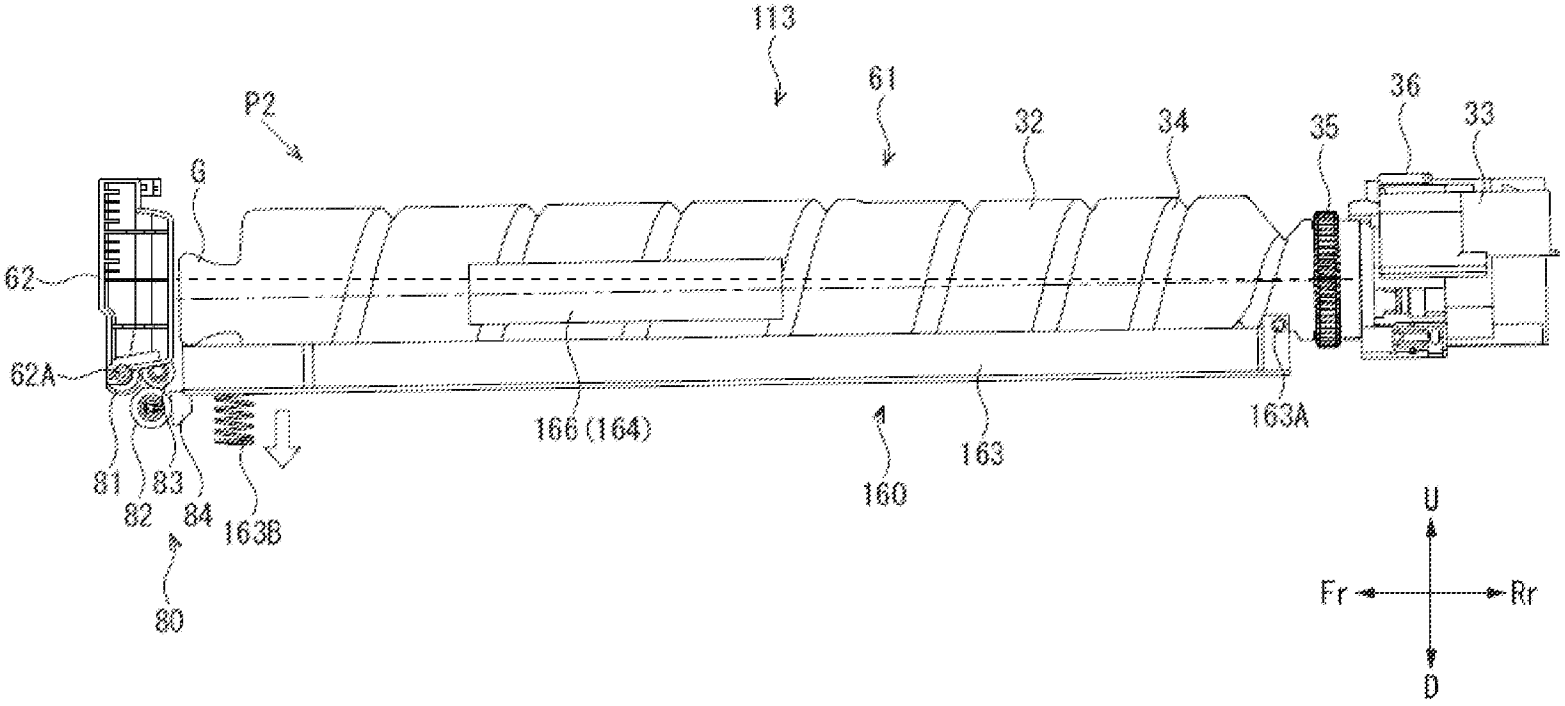
FIG. 19 is a side view showing the collecting bottle in a second posture in the waste toner collecting device according to the fifth embodiment of the present disclosure.
Figure 20:
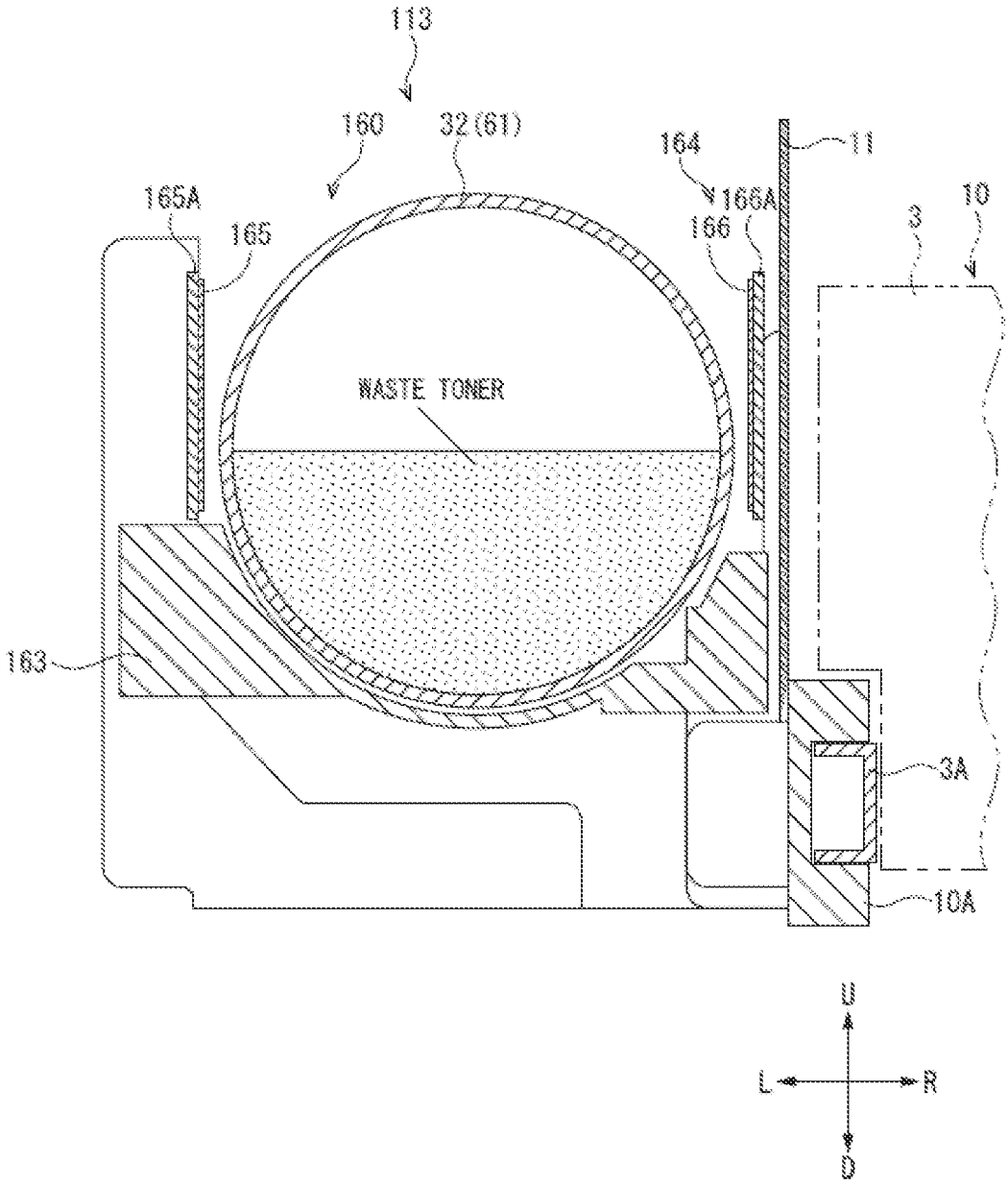
FIG. 20 is a sectional view taken along XX-XX line of FIG. 15.

Next, with reference to FIGS. 15-21, the waste toner collecting device 113 according to a fifth embodiment will be described. FIG. 15 is a plane view showing the sheet feeding cartridge 3, the waste toner collecting device 113 and others. FIG. 16 is a perspective view showing a front periphery of the waste toner collecting device 113. FIG. is a perspective view showing the waste toner collecting device 113. FIG. 18 is a side view showing the the collecting bottle 61 in a first posture P1 in the waste toner collecting device 113. FIG. 19 is a side view showing the the collecting bottle 61 in a second posture P2 in the waste toner collecting device 113. FIG. 20 is a sectional view taken along XX-XX line of FIG. 15. Incidentally, in the following description, the same components of the waste toner collecting device 113 as the waste toner collecting device 13 according to the first embodiment are indicated by the same references as the first embodiment, and the same description of the waste toner collecting device 113 as the waste toner collecting device 13 according to the first embodiment is omitted.

As shown in FIGS. 15 and 16, the waste toner collecting device 113 includes a collecting side attached part 160 (attached part) and the collecting bottle 61. To the collecting side attached part 160, the collecting bottle 61 is attached detachably. In the collecting bottle 61 (the container body 32), the waste toner discharged from the belt cleaning device 22 or the drum cleaning device 27 is stored. Incidentally, in the following description, the same components of the collecting side attached part 160 as the collecting side attached part 60 according to the first embodiment are indicated by the same references as the first embodiment, and the same description of the collecting side attached part 160 as the collecting side attached part 60 according to the first embodiment is omitted.

Figure 17:
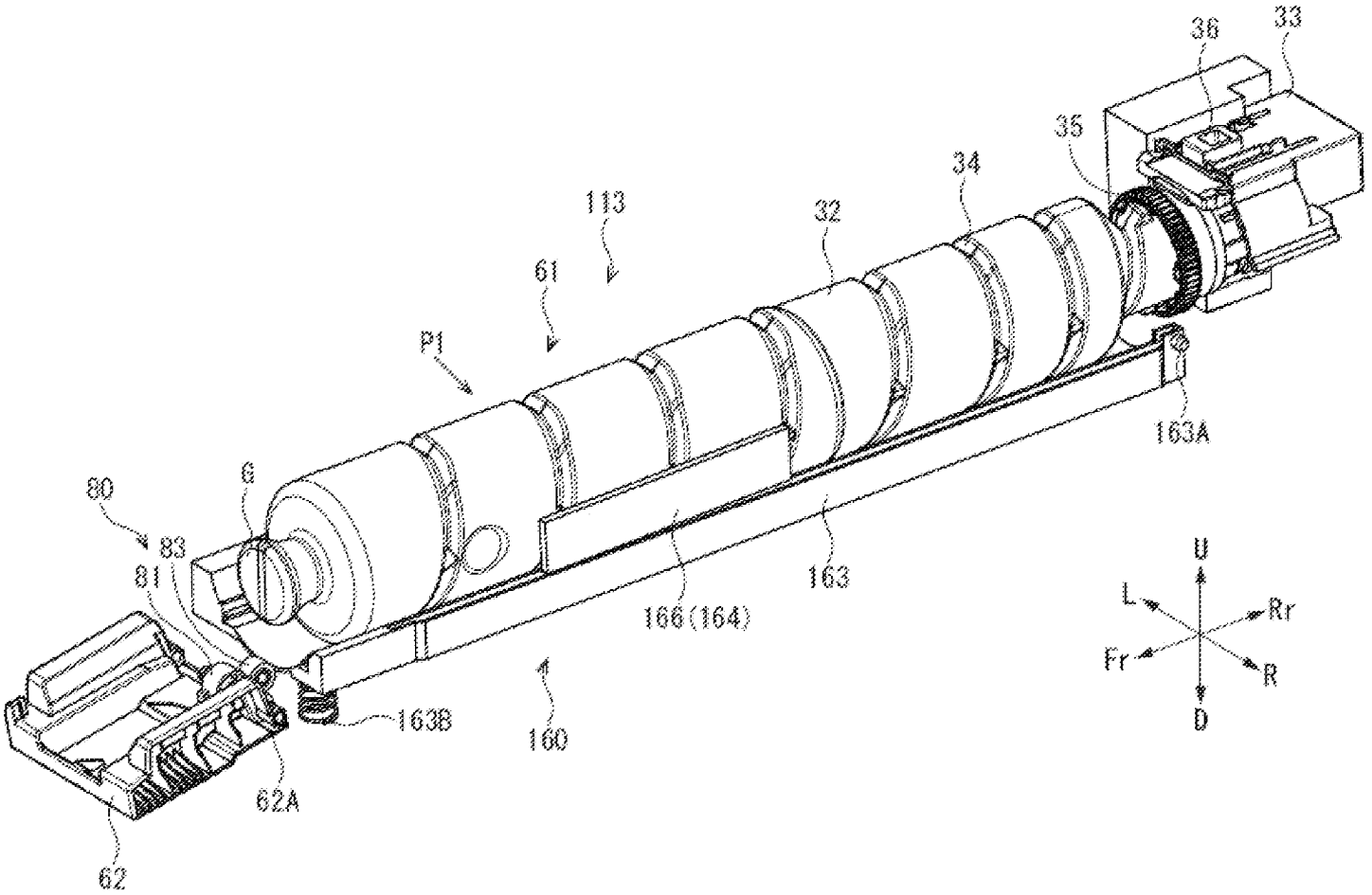
FIG. 17 is a perspective view showing the waste toner collecting device according to the fifth embodiment of the present disclosure.

As shown in FIGS. 15, 16 and 17, the collecting side attached part 160 includes the collecting cover 62, a supporting rail part 163, an angle changing mechanism 80 and a displacement sensor 164. The collecting cover 62 is provided in order to open or close a collecting side opening 160A of the collecting side attached part 160. The supporting rail part 163 supports the collecting bottle 61 slidably. The angle changing mechanism 80 raises and lowers (changes an inclination angle of) the collecting bottle 61 via the supporting rail part 163. The displacement sensor 164 detects electrostatic capacity according to the waste toner stored in the collecting bottle 61.

«<Collecting Cover>»

As shown in FIG. 17, the collecting cover 62 is made of, for example, synthetic resin, and a lower portion of the collecting cover 62 is connected to the collecting side attached part 160 (or the apparatus body 2) via a rotating shaft 62A extended in both left and right sides. The collecting cover 62 is provided so as to turn between a position opening the collecting side opening 160A and a position closing the collecting side opening 160A (referring to FIGS. 18 and 19).

«<Supporting Rail Part>»

The supporting rail part 163 is arranged in a lower portion of the collecting side attached part 160, and an upper face of the supporting rail part 163 is recessed according to a circumference face of the container body 32. The supporting rail part 163 supports the container body 32 slidably in an axial direction and rotatably around an axis. A rear end (a side of the communicating port 36) of the supporting rail part 163 is connected to the collecting side attached part 160 (or the apparatus body 2) via a rotating shaft 163A extended in both left and right sides. The supporting rail part 163 is supported so as to rotate (swing) in the upward and downward directions around the rotating shaft 163A. In a lower portion of the front side of the supporting rail part 163, a biasing member 163B is provided. The biasing member 163B is a compression coil spring interposed between the front side of the supporting rail part 163 and a frame of the collecting side attached part 160 (or the apparatus body 2). The biasing member 163B biases upward the front side of the supporting rail part 163.

«<Angle Changing Mechanism>»

As shown in FIG. 18, the angle changing mechanism 80 includes an input gear 81, an output gear 82, a middle gear 83 and a rack gear 84. The input gear 81, the output gear 82 and the middle gear 83 are spur gears. The input gear 81 is fixed to the rotating shaft 62A of the collecting cover 62 coaxially. The output gear 82 and the middle gear 83 are supported by the collecting side attached part 160 (or the apparatus body 2) rotatably around an axis. the middle gear 83 is arranged between the input gear 81 and the output gear 82 and meshed with both gears 81 and 82. The rack gear 84 is fixed to a lower portion of the front end of the supporting rail part 163 and meshed with the output gear 82.

The angle changing mechanism 80 sets the collecting bottle 61 arranged horizontally in the condition opening the collecting cover 62 to the first posture P1 of the collecting bottle 61 (referring to FIGS. 17 and 18) and sets the collecting bottle 61 inclined downwardly from the communicating port 36 to the front side (the other side in the axial direction) in the condition closing the collecting cover 62 to the second posture P2 of the collecting bottle 61 (referring to FIG. 19). The angle changing mechanism 80 has a function converting opening/closing operation of the collecting cover 62 to rotating operation of the supporting rail part 163. Incidentally, a term of "horizontal" used in the specification is not restricted by accurate horizontal, and means allowing a slight tolerance.

<Attaching of Collecting Bottle>

Hereupon, procedure attaching the collecting bottle 61 to the collecting side attached part 160 will be described. Incidentally, the condition opening the collecting cover is an initial condition of the collecting cover 62 (referring to FIGS. 17 and 18). In the condition opening the collecting cover 62, the output gear 82 is moved to a lower portion of the rack gear 84, and the supporting rail part 163 is held horizontally in the forward and backward directions (an axial direction).

The user inserts the collecting bottle 61 (the emptied toner bottle 31) into the collecting side attached part 160 (the collecting side opening 160A) in a state that the grip part G is directed to the front side and the communicating port 36 is directed to the upper side. In process inserting the collecting bottle 61, the shutter is slid relatively forward by coming into contact with a part of the collecting side attached part 160 to open the communicating port 36. The opened communicating port 36 is connected to the downstream end of the conveyance discharging tube 54 (referring to FIG. 7). Moreover, the collecting bottle 61 is supported by the supporting rail part 163 in the first posture P1 being horizontal in the forward and backward directions.

Next, the user turns backward the collecting cover 62 around the rotating shaft 62A to close the collecting cover 62. When the opened collecting cover 62 is rotated backward around the rotating shaft 62A, the input gear 81 is rotated in the same direction as the collecting cover 62. Rotation of the input gear 81 is transmitted to the output gear 82 via the middle gear 83, and the output gear 82 is rotated in the same direction as the input gear 81. Because the output gear 82 is rolled upwardly from the lower portion of the rack gear 84 relatively, the supporting rail part 163 to which the rack gear 84 is fixed is turned downward around the rotating shaft 163A while compressing the biasing member 163B. In the condition closing the collecting cover 62, the output gear 82 is moved to an upper portion of the rack gear 84, and the supporting rail part 163 becomes a posture inclined downwardly from the rear side to the front side (referring to FIG. 19). The collecting bottle 61 is supported by the supporting rail part 163 in the second posture P2 being inclined downwardly toward the front side (referring to FIG. 19). Incidentally, an inclined angle (an angle of a horizontal line shown by a broken line in FIG. 19 and a rotation center axis of the collecting bottle 61 shown by a one-dot chain line in FIG. 19) of the collecting bottle 61 in the second posture P2 (i.e. an inclined angle of the second posture P2) is set to, for example, 1-2 degrees, the inclined angle is not restricted by this example and may be freely set.

As described above, attaching of the collecting bottle 61 is completed (referring to FIGS. 15 and 16). A condition that attaching of the collecting bottle 61 is completed is similar to the first embodiment.

<Removing of Waste Toner>

Next, removing operation of the waste toner (the residual toner) will be described. In removing operation of the waste toner, the container body 32 (the conveying rib 34) is driven by the motor M and rotated around an axis (in an opposite direction to the container body 32 attached to the replenishing side attached part 30). When the container body 32 (the conveying rib 34) is rotated around the axis, the waste toner introduced from the communicating port 36 to the inside of the container body 32 is conveyed from the rear side to the front side (the other side in the axial direction). Since the collecting bottle 61 becomes the second posture P2 being inclined forward (referring to FIG. 19), the waste toner is easily flowed from the rear side to the front side. Moreover, the conveying rib 34 conveys the waste toner to the front side and makes a surface (an upper face) of the stored waste toner uniform.

«<Displacement Sensor>»

As shown in FIGS. 15-20, in the collecting side attached part 160, the displacement sensor 164 detecting an accumulation quantity (a storage quantity) of the waste toner stored in the collecting bottle 61 is provided. The displacement sensor 164 is an electrostatic capacity sensor arranged to face to the collecting bottle 61 attached to the collecting side attached part 160 to detect electrostatic capacity varying in accordance with the accumulation quantity of the waste toner stored in the collecting bottle 61. In detail, the displacement sensor 164 is an electrostatic capacity sensor in a mutual capacity manner detecting electric field change between a transmitting electrode 165 and a receiving electrode 166 arranged to face to each other across the collecting bottle 61. Incidentally, as an example, the displacement sensor 164 can detect the accumulation quantity of the waste toner by 0-100% with regard to capacity of the collecting bottle 61. However, the present disclosure is not restricted by this example, detectable range of the accumulation quantity may be freely defined.

As shown in FIGS. 16 and 20, the transmitting electrode 165 and the receiving electrode 166 are respectively mounted on rectangular substrates 165A and 166A lengthened in the forward and backward directions. The substrates 165A and 166A are provided in standing postures along the forward and backward directions and fixed to a frame (not shown) of the collecting side attached part 160. The transmitting electrode 165 and the receiving electrode 166 (the substrates 165A and 166A) are arranged above the supporting rail part 163. In addition, the transmitting electrode 165 and the receiving electrode 166 are arranged above the cartridge rails 10A and the slide guides 3A. The transmitting electrode 165 and the receiving electrode 166 are formed on faces of the substrates 165A and 166A at sides of the container body 32. The transmitting electrode 165 is arranged at an opposite side to the cartridge attached part 10 (at the left side of the apparatus body 2) across the collecting bottle 61. The receiving electrode 166 is arranged at a side of the cartridge attached part 10 (the sheet feeding cartridge 3). The transmitting electrode 165 and the receiving electrode 166 are electrically connected to the controlling part 17.

The collecting bottle 61, the transmitting electrode 165 and the receiving electrode 166 are arranged in roughly parallel to the rail holding members 11 (the cartridge rails 10A) (referring to FIG. 15). The transmitting electrode 165 and the receiving electrode 166 are arranged at positions not connecting to the container body 32 at the front side of the container body 32 (the other side from the center in the axial direction). The receiving electrode 166 is arranged between the container body 32 and the rail holding members 11 (as viewed from the front side). In addition, the receiving electrode 166 (the substrate 166A) is arranged to not connect to the rail holding members 11 and to face to the rail holding members 11. Exactly, a front portion (a part) of the receiving electrode 166 is overlapped with the rail holding members 11 provided unmovably.

As the accumulation quantity of the waste toner in the collecting bottle 61 is increased, electric field (electrostatic capacity) between the transmitting electrode 165 and the receiving electrode 166 is changed. The controlling part 17 receives an output (detecting result) from the displacement sensor 164 at regular intervals to decide the accumulation quantity of the waste toner in the collecting bottle 61.

Moreover, the displacement sensor 164 can detect an attaching/detaching state of the collecting bottle 61 to the collecting side attached part 160 and an opening/closing state of the collecting cover 62 in addition to the accumulation quantity of the waste toner in the collecting bottle 61.

Because the displacement sensor 164 faces to the collecting bottle 61 (the container body 32) attached to the collecting side attached part 160, the electric field (the electrostatic capacity) between the transmitting electrode 165 and the receiving electrode 166 is changed in accordance with presence/absence of the collecting bottle 61 in the collecting side attached part 160. Incidentally, the collecting bottle 61 may be empty or stores the waste toner.

Moreover, as shown in FIG. 18, the transmitting and receiving electrodes 165 and 166 are arranged so as to be inclined (intersect) with regard to the rotation center axis (referring to a one-dot chain line in FIG. 18) of the collecting bottle 61 when the collecting bottle 61 is the first posture P1. By contract, as shown in FIG. 19, the transmitting and receiving electrodes 165 and 166 are arranged so as to be in roughly parallel to the rotation center axis (referring to a one-dot chain line in FIG. 19) of the collecting bottle 61 when the collecting bottle 61 is the second posture P2. Therefore, in accordance with opening/closing of the collecting cover 62, since a distance of a circumference face of the container body 32 and the displacement sensor 164 is slightly varied, the electric field (the electrostatic capacity) between the transmitting electrode 165 and the receiving electrode 166 is changed.

Figure 21:
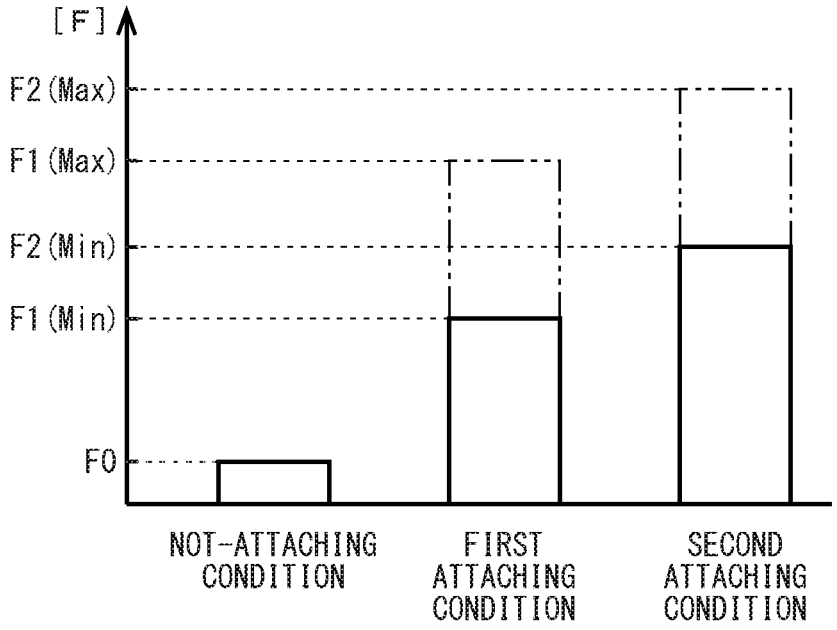
FIG. 21 is a graph plotting electrostatic capacities detected in respective conditions by the displacement sensor of the waste toner collecting device according to the fifth embodiment of the present disclosure.

Next with reference to FIG. 21, conditions which can be detected by the displacement sensor 164 will be described. FIG. 21 is a graph plotting electrostatic capacities detected in respective conditions by the displacement sensor 164. Incidentally, values of the electrostatic capacities shown in FIG. 21 are values for explanation, but do not always indicate correct values.

The displacement sensor 164 detects the electrostatic capacity varying in accordance with the storage quantity of the waste toner stored in the collecting bottle 61, attaching/detaching of the collecting bottle 61 and opening/closing of the collecting cover 62 (exactly, posture changing of the collecting bottle 61). Concretely, the displacement sensor 164 detects the electrostatic capacity varying among a not-attaching condition, a first attaching condition and a second attaching condition. The not-attaching condition is a condition that the collecting bottle 61 is detached from the collecting side attached part 160 regardless of opening/closing of the collecting cover 62. The first attaching condition is a condition that the collecting cover 62 is opened and the collecting bottle 61 is attached to the collecting side attached part 160. That is, the first attaching condition is a condition that the collecting bottle 61 is set to the first posture P1. The second attaching condition is a condition that the collecting cover 62 is closed and the collecting bottle 61 is attached to the collecting side attached part 160. That is, the second attaching condition is a condition that the collecting bottle 61 is set to the second posture P2. Moreover, the displacement sensor 164 detects the electrostatic capacity varying in accordance with the accumulation quantity of the waste toner stored in the collecting bottle 61 in the first and second attaching conditions.

In the not-attaching condition, the displacement sensor 164 detects an electrostatic capacity F0 of the not-attaching condition corresponding to dielectric constant of an air in the collecting side attached part 160. In the first attaching condition, the displacement sensor 164 detects an electrostatic capacity FP1 of the first posture corresponding to a total of dielectric constants of the collecting bottle 61 (the container body 32) being the first posture P1 and the waste toner in the container body 32. In the second attaching condition, the displacement sensor 164 detects an electrostatic capacity FP2 of the second posture corresponding to a total of dielectric constants of the collecting bottle 61 (the container body 32) being the second posture P2 and the waste toner in the container body 32.

The electrostatic capacity F0 of the not-attaching condition is roughly constant. The electrostatic capacity FP1 of the first posture and the electrostatic capacity FP2 of the second posture may be changed in accordance with the accumulation quantity (0-100% of an accumulation rate) of the waste toner stored in the collecting bottle 61. Therefore, the first attaching condition and the second attaching condition are conditions having predetermined ranges (minimum to maximum values).

The electrostatic capacity F2 is a larger value than the first electrostatic capacity F1, the minimum value (Min) of the electrostatic capacity FP1 of the first posture is a larger value than the electrostatic capacity F0 of the not-attaching condition, and the minimum value (Min) of the electrostatic capacity FP2 of the second posture is a larger value than the minimum value (Min) of the electrostatic capacity FP1 of the first posture (F0<FP1(Min)<FP2(Min)). In a memory (not shown) of the controlling part 17, the electrostatic capacity F0 of the not-attaching condition and the minimum values (Min) and the maximum values (Max) of the electrostatic capacity FP1 of the first posture and the electrostatic capacity FP2 of the second posture are stored in advance. Incidentally, the minimum values (Min) of the electrostatic capacities FP1 and FP2 of the first posture and the second posture are electrostatic capacities corresponding to the emptied collecting bottle 61 (0% of the accumulation rate), and the maximum values (Max) of the electrostatic capacities FP1 and FP2 of the first posture and the second posture are electrostatic capacities corresponding to the full collecting bottle 61 (100% of the accumulation rate).

Incidentally, it is feared that the output of the displacement sensor 164 is varied in accordance with attaching/detaching of the adjacent sheet feeding cartridge 3 and the displacement sensor 164 does not detect correct electrostatic capacity. However, since the rail holding member 11 covers the receiving electrode 166, even if the sheet feeding cartridge 3 is attached/detached, a distance of the receiving electrode 166 and the rail holding member 11 is kept constant, and varying of the electrostatic capacity detected by the displacement sensor 164 is restrained. Thereby, it is possible to detect correct electrostatic capacity.

<Detecting of Electrostatic Capacity>

Next, detecting of the electrostatic capacity in each condition by using the displacement sensor 164 will be described. The controlling part 17 receives an output (detecting result) from the displacement sensor 164 at regular intervals. Incidentally, the interval (a sampling rate) receiving the output from the displacement sensor 164 may be freely defined.

In a case where the detecting result is the electrostatic capacity F0 of the not-attaching condition, the controlling part 17 decides the not-attaching condition, and displays, for example, a message or the like indicating not-attaching of the collecting bottle 61 on the touch panel (not shown) provided in the image forming apparatus 1. In a case where the detecting result is the minimum (Min) of the electrostatic capacity FP1 of the first posture, the controlling part 17 decides the first attaching condition and that the emptied collecting bottle 61 is attached and the collecting cover 62 is forgotten to close, and displays, for example, a message or the like encouraging closing of the collecting cover 62 on the touch panel. Incidentally, in a case where the controlling part 17 decides the not-attaching condition or the first attaching condition, the controlling part 17 restrict performing of the image forming process.

In a case where the detecting result is the minimum (Min) of the electrostatic capacity FP2 of the second posture, the controlling part 17 decides the second attaching condition and that the emptied collecting bottle 61 is attached and the collecting cover 62 is closed, and allows performing of the image forming process. While or after performing of the image forming process, the controlling part 17 receives the detecting result from the displacement sensor 164 at regular intervals and calculates the accumulation quantity of the waste toner stored in the collecting bottle 61. In a case where the detecting result is the maximum (Max) of the electrostatic capacity FP2 of the second posture, the controlling part 17 decides that the collecting bottle 61 becomes full, and promptly stops image forming operation. Moreover, the controlling part 17 displays, for example, a message or the like indicating full of the collecting bottle 61 or encouraging replacement of the collecting bottle 61 on the touch panel.

In a case replacing the full collecting bottle 61, when the user opens the collecting cover 62, the supporting rail part 163 is raised by operation of the angle changing mechanism 80 and biasing force of the biasing member 163B, and the collecting bottle 61 is posture-changed from the second posture P2 to the first posture P1 (referring to FIG. 18). The user grasps the grip part G and pulls the collecting bottle 61 out to the front side, and thereby, detaches the collecting bottle 61 from the collecting side attached part 160. According to pulling-out of the collecting bottle 61, the shutter is biased backward by the spring (not shown) to close the communicating port 36.

Incidentally, for example, in a case where the waste toner is stored in the collecting bottle 61 and others, because the electrostatic capacity FP1 of the first posture has an overlapped range with the electrostatic capacity FP2 of the second posture, the controlling part 17 may not decide the condition by only a level of the electrostatic capacity. However, when the condition is shifted between the first attaching condition and the second attaching condition, since the electrostatic capacity (an electrostatic capacity corresponding to posture changing of the collecting bottle 61) is significantly increased/decreased in a moment, the controlling part 17 can decide shifting between the first attaching condition and the second attaching condition by referring to varying a quantity of the electrostatic capacity within a predetermined time. Moreover, in a case where the controlling part 17 cannot decide the condition, the controlling part 17 displays, for example, a message indicating that on the touch panel.

In the waste toner collecting device 113 (the container attachment device) according to the above-described fifth embodiment, by opening the collecting cover 62 when replacing the collecting bottle 61, it is possible to set the collecting bottle 61 to a horizontal posture (the first posture P1). Thereby, it is possible to provide operability in which wrong feeling of user is little, such as horizontal inserting/pulling of the collecting bottle 61 and to smoothly perform replacing work of the collecting bottle 61. Moreover, in accordance with the waste toner collecting device 113, by closing the collecting cover 62, it is possible to set the collecting bottle 61 to the second posture P2. Thereby, the waste toner introduced from the communicating port 36 to the inside can be easily flowed in a direction away from the communicating port 36 by using downward inclination. As described above, it is possible to change the posture of the collecting bottle 61 in accordance with opening/closing of the collecting cover 62 and to make the posture of the collecting bottle 61 well in accordance with replacing of the collecting bottle 61 and activating of the image forming apparatus 1 (performing of the image forming process).

In accordance with the waste toner collecting device 113 according to the fifth embodiment, it is possible to transmit turning force of the collecting cover 62 to the supporting rail part 163 directly via the angle changing mechanism 80 and to correctly interlock opening/closing of the collecting cover 62 and raising/lowering of the supporting rail part 163.

Moreover, in accordance with the waste toner collecting device 113 according to the fifth embodiment, it is configured that the collecting bottle 61 is raised/lowered in accordance with opening/closing of the collecting cover 62. In such a configuration, since a distance of a circumference face of the collecting bottle 61 and the transmitting and receiving electrodes 165 and 166 is varied, it is possible to detect various electrostatic capacity by the displacement sensor 164. Thereby, by the displacement sensor 164 detecting the accumulation quantity of the waste toner stored in the collecting bottle 61, it is possible to detect the electrostatic capacity according to presence/absence of the collecting bottle 61 and posture changing of the collecting bottle 61 interlocking with opening/closing of the collecting cover 62. As a result, in comparison with a case detecting the accumulation quantity of the waste toner, opening/closing of the collecting cover 62 and others by several sensors, it is possible to simplify the configuration of the waste toner collecting device 113 and to reduce manufacturing cost.

Further, in accordance with the waste toner collecting device 113 according to the fifth embodiment, since the collecting bottle 61 is posture-changed (raised or lowered) between the transmitting and receiving electrodes 165 and 166, it is possible to detect variation of the distance of the circumference face of the collecting bottle 61 and the transmitting and receiving electrodes 165 and 166 by the displacement sensor 164. Thereby, it is possible to detect opening/closing of the collecting cover 62 by the displacement sensor 164 detecting the accumulation quantity of the waste toner, and to prevent forgetting to close the collecting cover 62 and to secure regular driving connection.

Furthermore, in accordance with the waste toner collecting device 113 according to the fifth embodiment, since the cylindrical container body 32 is rotated around an axis, a distance of the displacement sensor 164 and the container body 32 is not changed by rotation of the container body 32, and it is possible to keep this distance constant. Thereby, since the displacement sensor 164 can detect correct electrostatic capacity, it is possible to appropriately detect the accumulation quantity of the waste toner stored in the collecting bottle 61. Moreover, by rising or lowering the cylindrical container body 32 in accordance with opening/closing of the collecting cover 62, since a distance of a circumference face of the container body 32 and the displacement sensor 164 is varied, it is possible to detect opening/closing of the collecting cover 62 by the displacement sensor 164.

Incidentally, in the waste toner collecting device 113 according to the fifth embodiment, as an example, although the front side of the receiving electrode 166 faces to the rail holding member 11, the present disclosure is not restricted by this example. A rear side of the receiving electrode 166 or the whole of the receiving electrode 166 may be arranged to face to the rail holding member 11 (not shown). Moreover, in the waste toner collecting device 113 according to the fifth embodiment, as an example, although the receiving electrode 166 of the displacement sensor 164 is arranged to face to the rail holding member 11, the present disclosure is not restricted by this example. The receiving electrode 166 and the transmitting electrode 165 may be replaced to each other and the transmitting electrode 165 may be arranged to face to the rail holding member 11 (not shown). That is, the rail holding member 11 may be arranged to face to at least a part of the displacement sensor 164. Further, n the waste toner collecting device 113 according to the fifth embodiment, as an example, although the transmitting electrode 165 and the receiving electrode 166 are arranged to face to each other in the left and right directions, the present disclosure is not restricted by this example. The transmitting electrode 165 and the receiving electrode 166 may be arranged to face to each other in the upward and downward directions (not shown).

Sixth Embodiment

Figure 22:
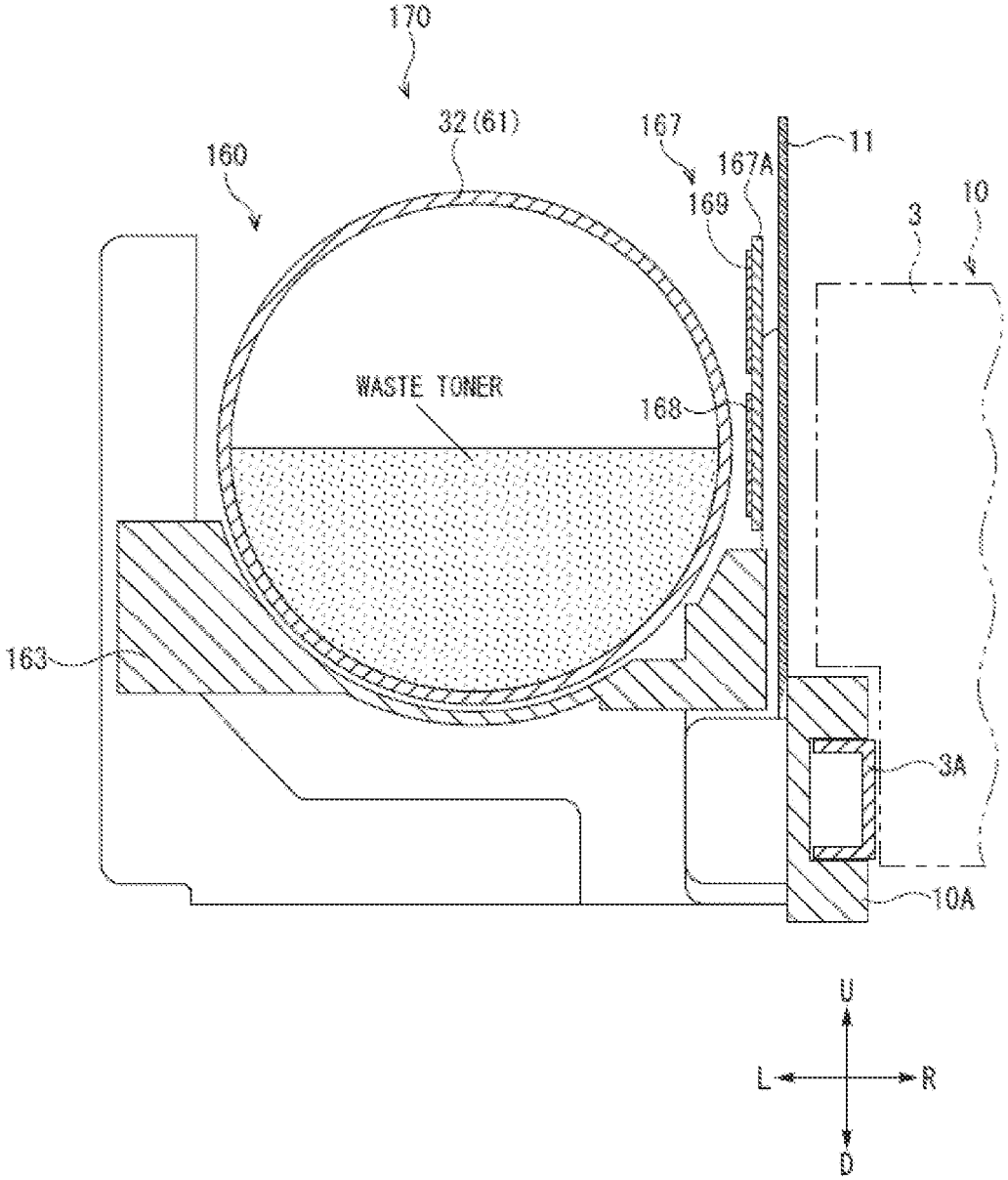
FIG. 22 is a front sectional view showing the waste toner collecting device and others according to a sixth embodiment of the present disclosure.

Next, with reference to FIG. 22, the waste toner collecting device 170 according to a sixth embodiment will be described. FIG. 22 is a front sectional view showing the waste toner collecting device 170 and others. Incidentally, in the following description, the same components of the waste toner collecting device 170 as the waste toner collecting device 113 according to the fifth embodiment are indicated by the same references as the fifth embodiment, and the same description of the waste toner collecting device 170 as the waste toner collecting device 113 according to the fifth embodiment is omitted.

In the waste toner collecting device 170 according to the sixth embodiment, the transmitting electrode 168 and the receiving electrode 169 of the displacement sensor 167 are mounted on one substrate 167A in parallel in the upward and downward directions. In FIG. 22, as an example, although, the transmitting electrode 168 is arranged at the lower side in the substrate 167A and the receiving electrode 169 is arranged at the upper side in the substrate 167A, arrangement of the transmitting electrode 168 and the receiving electrode 169 may be replaced in the upward and downward directions. The displacement sensor 167 is an electrostatic capacity sensor in a mutual capacity manner detecting electric field change between the transmitting electrode 168 and the receiving electrode 169 arranged to face to a right side face of the collecting bottle 61 (between the collecting bottle 61 and the rail holding member 11). The transmitting and receiving electrodes 168 and 169 do not come into contact with the rail holding member 11 and front sides (parts) of the transmitting and receiving electrodes 168 and 169 are overlapped with the rail holding member 11.

In accordance with the waste toner collecting device 170 according to the above-described sixth embodiment, it is possible to achieve the same operation and effect as the waste toner collecting device 113 according to the fifth embodiment, for example, it is possible to detect opening/closing of the collecting cover by using the displacement sensor 167 detecting the accumulation quantity of the waste toner.

Incidentally, in the waste toner collecting device 170 according to the sixth embodiment, as an example, although the front sides of the transmitting and receiving electrodes 168 and 169 face to the rail holding member 11, the present disclosure is not restricted by this example. Rear sides of the transmitting and receiving electrodes 168 and 169 or the whole of the transmitting and receiving electrodes 168 and 169 may be arranged to face to the rail holding member 11 (not shown). Alternatively, the transmitting electrode 168 or the receiving electrode 169 may be arranged to face to the rail holding member 11 (not shown). Moreover, the transmitting electrode 168 and the receiving electrode 169 may be mounted in parallel in the left and right directions on one substrate 167A (not shown).

Incidentally, in the waste toner collecting device 113 or 170 according to the fifth and sixth embodiments, as an example, although the horizontal posture of the collecting bottle 61 is set to the first posture P1, the present disclosure is not restricted by this example. For example, a posture of the collecting bottle 61 inclined upwardly from the communicating port 36 to the front side (the other side in the axial direction) may be set to the first posture P1 (not shown).

Seventh Embodiment

In the above-described fifth to sixth embodiments, as an example, although features of the present disclosure is applied to the waste toner collecting device 13 so that the displacement sensor 164 or 167 for sensing of full is used in common for sensing of attaching/detaching of the collecting bottle 61 and sensing of opening/closing of the collecting cover 62, the present disclosure is not restricted by this example. As another example of the container attachment device, the features of the disclosure may be applied to the toner replenishing device (a seventh embodiment). Concretely, the residual quantity confirmation sensor for sensing a residual quantity of the toner bottle 31 (the replenishing toner) may be used in common for sensing of attaching/detaching of the toner bottle 31 and sensing of opening/closing of the replenishing cover 37 (exactly, posture changing of the toner bottle 31 interlocking with opening/closing of the replenishing cover 37). Further concretely, the angle changing mechanism (not shown) converts opening/closing operation of the replenishing cover 37 to rotating operation of the supporting rail part (not shown) of the toner bottle 31. Subsequently, the angle changing mechanism set a condition of the toner bottle 31 being horizontal in a condition opening the replenishing cover 37 to the first posture P1, and set a condition of the toner bottle 31 being inclined downwardly from the front side (the other side in the axial direction) to the communicating port 36 in a condition closing the replenishing cover 37 to the second posture P2. In such a configuration, the replenishing toner can be easily flowed to the communicating port 36. Incidentally, the features of the disclosure may be used for both of the toner replenishing device 12 and the waste toner collecting device 113 or 70.

Moreover, the features of the waste toner collecting device 113 or 170 according to the fifth to sixth embodiments may be applied to the toner replenishing device 12 according to the seventh embodiment.

Moreover, in the waste toner collecting device 113 or 170 according to the fifth to sixth embodiments or the toner replenishing device 12 according to the seventh embodiment, as an example, the angle changing mechanism 80 is composed of a plurality of gears 81-84, the present disclosure is not restricted by this example. For example, the angle changing mechanism may be composed of a solenoid or a piston and cylinder for rising and lowering the supporting rail part 163.

Further, in the waste toner collecting device 113 or 170 according to the fifth to sixth embodiments or the toner replenishing device 12 according to the seventh embodiment, as an example, the angle changing mechanism 80 changes the posture of the toner bottle 31 or the collecting bottle 61 by rising and lowering the supporting rail part 163, the present disclosure is not restricted by this example. For example, the angle changing mechanism may have an acting member (not shown) coming contact with the toner bottle 31 or the collecting bottle 61 and directly change the posture of the toner bottle 31 or the collecting bottle 61 by the acting member.

Furthermore, in the fifth to seventh embodiments, as an example, the biasing member 163B biasing upwardly the supporting rail part 163, the present disclosure is not restricted by this example. For example, even if posture changing of the collecting bottle 61 can be actualized by only the angle changing mechanism 80, the biasing member 163B may be omitted (removed).

Incidentally, in the first to seventh embodiments, as an example, although the container body 32 of the toner bottle 31 or the collecting bottle 61 is rotated around the axis to convey the inside toner (the replenishing toner or the waste toner) in the axial direction, the present disclosure is not restricted by this example. For example, as a modified example, a toner container may be configured so that a screw conveying the toner is incorporated in the container body (not shown). In such a case, when the container body is attached to the replenishing side attached part 30 or the collecting side attached part 60 or 160 and the inside screw is rotated in an axis, the toner inside the container body is conveyed in the axial direction.

Moreover, as an example, although the waste toner collecting device 13, 70, 71, 113 or 170 according to the first to third, fifth and sixth embodiments or the toner replenishing device 12 according to the fourth and seventh embodiments is controlled by the controlling part 17 provided in the image forming apparatus, the present disclosure is not restricted by this example. An exclusive controlling part for controlling the waste toner collecting device 13, 70, 71, 113 or 170 or the toner replenishing device 12 may be provided in place of the controlling part 17.

Further, in the first to seventh embodiment, as an example, although the displacement sensor 64, 67, 164 or 167 does not come into contact with the rail holding member 11, the present disclosure is not restricted by this example. For example, the substrate 64A, 67A, 164A or 167A may come into contact with (is fixed to) the rail holding member 11. Moreover, in order to secure smooth rotation and others of the container body 32, although the displacement sensor 64, 67, 164 or 167 does not come into contact with the collecting bottle 61, the present disclosure is not restricted by this example. For example, the displacement sensor 64, 67, 164 or 167 may come into contact with the collecting bottle 61.

Although the present embodiment has been described about a case where a configuration of the present disclosure is applied to the image forming apparatus 1 (color printer), the present disclosure is not restricted by this case, the configuration of the disclosure may be applied to a monochrome printer, a copying machine, a facsimile, a multifunction peripheral or the like.

Incidentally, the above-description of the embodiments illustrates one aspect of the container attachment device and an image forming apparatus according to the present disclosure, but the technical scope of the disclosure is not limited to the above-described embodiments. The disclosure may be variously changed, replaced or modified within a range not deviated from the basis of the technical idea and the claims include all embodiments included within the range of the technical idea.

The invention claimed is:

1. A container attachment device comprising:

a toner container extended in an axial direction and formed so as to store a toner, and having a communicating port arranged one side in the axial direction to discharge or to introduce the toner;

an attached part to which the toner container is attached detachably along the axial direction; and a displacement sensor provided unmovably and arranged to face to the toner container attached to the attached part to detect electrostatic capacity according to the toner stored in the toner container, wherein the attached part includes:

a cover opening/closing an opening for attaching/detaching the toner container, wherein the cover is provided so as to turn between a position opening the opening and a position closing the opening;

a supporting rail part supporting the toner container slidably, wherein the supporting rail part is supported so as to rotate in upward and downward directions around a rotation shaft arranged at a side of the communicating port; and an angle changing mechanism setting the toner container arranged horizontally in a condition opening the cover to a first posture of the toner container by rotating the supporting rail part upwardly in interlocking with opening operation of the cover and setting the toner container inclined downwardly from the communicating port to the other side in the axial direction in a condition closing the cover to a second posture of the toner container by rotating the supporting rail part downwardly in interlocking with closing operation of the cover, the displacement sensor detects the electrostatic capacity varying among a not-attaching condition in which the toner container is detached from the attached part, a first attaching condition in which the toner container is set to the first posture, and a second attaching condition in which the toner container is set to the second posture, in the first attaching condition or the second attaching condition, the displacement sensor detects the electrostatic capacity varying in accordance with a quantity of the toner stored in the toner container.

2. The container attachment device according to claim 1 wherein, the displacement sensor detects electric field change between a transmitting electrode and a receiving electrode arranged to face to each other across the toner container.

3. The container attachment device according to claim 1 wherein, the toner container includes:

a container body formed in a cylindrical shape and including a helical conveying rib protruded to an inner side in a radial direction from an outer circumference face of the container body; and a cap supporting one side in an axial direction of the container body rotatably around an axis and including the communicating port communicating with an inside of the container body, the attached part fixes the cap and supports the container body rotatably, the container body attached to the attached part conveys, by rotating rotated around an axis, the toner introduced from the communicating port to the inside of the container body toward the other side in the axial direction.

4. An image forming apparatus comprising:

the container attachment device according to claim 1.

* * * * *